US011719495B2

(12) United States Patent
Sun et al.

(10) Patent No.: US 11,719,495 B2
(45) Date of Patent: Aug. 8, 2023

(54) PLATE HEAT EXCHANGER, HEAT PUMP DEVICE INCLUDING PLATE HEAT EXCHANGER, AND HEAT PUMP TYPE OF COOLING, HEATING, AND HOT WATER SUPPLY SYSTEM INCLUDING HEAT PUMP DEVICE

(71) Applicant: Mitsubishi Electric Corporation, Tokyo (JP)

(72) Inventors: Faming Sun, Tokyo (JP); Susumu Yoshimura, Tokyo (JP); Yoshitaka Eijima, Tokyo (JP); Sho Shiraishi, Tokyo (JP); Ryosuke Abe, Tokyo (JP); Masahiro Yokoi, Tokyo (JP); Kazutaka Suzuki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 525 days.

(21) Appl. No.: 16/979,047

(22) PCT Filed: Feb. 28, 2019

(86) PCT No.: PCT/JP2019/007857
§ 371 (c)(1),
(2) Date: Sep. 8, 2020

(87) PCT Pub. No.: WO2019/176565
PCT Pub. Date: Sep. 19, 2019

(65) Prior Publication Data

US 2020/0408475 A1 Dec. 31, 2020

(30) Foreign Application Priority Data

Mar. 15, 2018 (JP) ..... 2018-047954

(51) Int. Cl.
*F28F 3/08* (2006.01)
*F24H 4/02* (2022.01)
(Continued)

(52) U.S. Cl.
CPC ..... *F28F 3/086* (2013.01); *F24H 4/02* (2013.01); *F25B 13/00* (2013.01); *F25B 39/00* (2013.01); *F25B 39/04* (2013.01); *F28F 2265/16* (2013.01)

(58) Field of Classification Search
CPC ..... F28F 3/086; F28F 3/10; F28F 2265/16; F24H 4/02; F25B 13/00; F25B 39/00; F25B 39/04; F28D 9/00; F28D 9/005
See application file for complete search history.

(56) References Cited

U.S. PATENT DOCUMENTS 5,249,358 A 10/1993 Tousignant et al.
5,832,736 A 11/1998 Yoshioka et al.
(Continued)

FOREIGN PATENT DOCUMENTS

CN 1163389 A 10/1997
CN 1550746 A 12/2004
(Continued)

OTHER PUBLICATIONS

German Office Action dated Nov. 11, 2021, in German patent Application No. 11 2019 001 344.0.
(Continued)

*Primary Examiner* — Len Tran
*Assistant Examiner* — Kamran Tavakoldavani
(74) *Attorney, Agent, or Firm* — Xsensus LLP

(57) ABSTRACT

A plate heat exchanger includes heat transfer plates having openings at four corners thereof, having outer wall portions at their edges, and stacked together. The heat transfer plates are partially brazed together such that a first flow passage for
(Continued)

first fluid and a second flow passage for second fluid are alternately arranged, with a heat transfer plate interposed between these flow passages, the openings communicating with each other, forming a first header allowing the first fluid to flow into and out of the first flow passage and a second header allowing the second fluid to flow into and out of the second flow passage. One heat transfer plate located between the first or second flow passage is formed by stacking two metal plates. Space between the metal plates includes a fine flow passage located within a heat exchange region, and a peripheral leakage passage outward of the fine flow passage.

19 Claims, 20 Drawing Sheets

(51) Int. Cl.

| | |
|---|---|
| ***F25B 13/00*** | (2006.01) |
| ***F25B 39/00*** | (2006.01) |
| ***F25B 39/04*** | (2006.01) |

(56) References Cited

U.S. PATENT DOCUMENTS

| | | | | |
|---|---|---|---|---|
| 2004/0256083 | A1 | 12/2004 | Rehberg et al. | |
| 2011/0088882 | A1 | 4/2011 | Persson | |
| 2012/0111042 | A1 | 5/2012 | Hamada et al. | |
| 2014/0094617 | A1 | 4/2014 | Dubois | |
| 2015/0083379 | A1 | 3/2015 | Ito et al. | |
| 2016/0040943 | A1 | 2/2016 | Han et al. | |
| 2016/0356560 | A1 | 12/2016 | Wei et al. | |
| 2017/0241716 | A1* | 8/2017 | Schatz-Knecht | F28F 3/10 |

FOREIGN PATENT DOCUMENTS

| | | | |
|---|---|---|---|
| CN | 102027306 | A | 4/2011 |
| CN | 102472540 | A | 5/2012 |
| CN | 103759474 | A | 4/2014 |
| CN | 104334994 | A | 2/2015 |
| DE | 41 00 651 | A1 | 7/1992 |
| DE | 693 24 937 | T2 | 2/2000 |
| DE | 10 2015 012 029 | A1 | 3/2017 |
| JP | 2001 -99587 | A | 4/2001 |
| JP | 2012-127597 | A | 7/2012 |
| JP | 2016-99093 | A | 5/2016 |
| KR | 10 2018 022472 | | 3/2018 |
| WO | WO 2013/183629 | A1 | 12/2013 |

OTHER PUBLICATIONS

Office Action dated Jul. 30, 2021, in corresponding Chinese patent Application No. 201980018110.1, 13 pages.

Chinese Office Action dated Mar. 30, 2022, in corresponding Chinese Patent Application No. 201980018110.1, 15 pp.

International Search Report dated May 21, 2019 in PCT/JP2019/007857 filed on Feb. 28, 2019, 2 pages (*see notation on ISR).

* cited by examiner

PLATE HEAT EXCHANGER, HEAT PUMP DEVICE INCLUDING PLATE HEAT EXCHANGER, AND HEAT PUMP TYPE OF COOLING, HEATING, AND HOT WATER SUPPLY SYSTEM INCLUDING HEAT PUMP DEVICE

TECHNICAL FIELD

The present disclosure relates to a plate heat exchanger having a double wall structure, a heat pump device including the plate heat exchanger, and a heat pump type of cooling, heating, and hot water supply system including the heat pump device.

BACKGROUND ART

An existing plate heat exchanger includes a plurality of heat transfer plates which each have openings at four corners thereof and corrugated surfaces, the heat transfer plates being stacked together such that flow passages for two types of fluids that are to exchange heat with each other are alternately provided between adjacent ones of the heat transfer plates (see, for example, Patent Literature 1).

In a plate heat exchanger disclosed in Patent Literature 1, flow passages for two types of fluids that are adjacent to each other are separated from each other by a three-layer plate unit formed by joining three heat transfer plates having the same shape together into a single plate shape, with adhesion prevention layers partially provided between the three heat transfer plates. Since the adhesion prevention layers are partially provided between the three heat transfer plates, even when the heat transfer plates that separate the adjacent flow passages for the two types of fluids from each other have a defect and when a fluid leakage occurs in one of the flow passages, the fluid that has leaked can be reliably discharged to the outside and the two types of fluids in the respective flow passages are prevented from being mixed.

CITATION LIST

Patent Literature

Patent Literature 1: Japanese Unexamined Patent Application Publication No. 2001-99587

SUMMARY OF INVENTION

Technical Problem

However, in the plate heat exchanger according to Patent Literature 1, it takes a long time to detect leakage when fluid that has leaked is discharged at a low flow rate. In addition, since an outflow passage along which the fluid flows out to the outside cannot be easily determined, a plurality of detection sensors that detect fluid leakage need to be installed outside the plate heat exchanger. Inevitably, the cost is increased.

The present disclosure is applied to solve the above problem, and relates to a plate heat exchanger with which leakage can be detected in a shorter time and the cost can be reduced, a heat pump device including the plate heat exchanger, and a heat pump type of cooling, heating, and hot water supply system including the heat pump device.

Solution to Problem

A plate heat exchanger according to an embodiment of the present disclosure includes a plurality of heat transfer plates which each have openings at four corners thereof, the plurality of heat transfer plates having outer wall portions at edges thereof and being stacked together. The plurality of heat transfer plates are partially brazed together such that a first flow passage through which first fluid flows and a second flow passage through which second fluid flows are alternately provided, with an associated one of the plurality of heat transfer plates interposed between the first flow passage and the second flow passage. The openings at the corners of the plurality of heat transfer plates are provided such that the openings at each of the corners communicate with each other, thereby forming a first header and a second header, the first header being configured to allow the first fluid to flow into and flow out of the first flow passage, the second header being configured to allow the second fluid to flow into and flow out of the second flow passage. At least one of two of the plurality of heat transfer plates between which the first flow passage or the second flow passage is located is formed by stacking two metal plates together. The space between the two metal plates includes a fine flow passage that is located within a heat exchange region in which the first fluid and the second fluid exchange heat, and a peripheral leakage passage provided outward of the fine flow passage to communicate with the outside of the space and having a hydraulic diameter greater than a hydraulic diameter of the fine flow passage.

Advantageous Effects of Invention

In the plate heat exchanger according to the embodiment of the present disclosure, the space between the pair of metal plates includes: the fine flow passage that is located within the heat exchange region in which the first fluid and the second fluid exchange heat with each other; and the leakage passage provided outward of the fine flow passage to communicate with the outside and having a hydraulic diameter greater than that of the fine flow passage. When fluid leakage occurs, the fluid that has leaked flows through the fine flow passage, join in the peripheral leakage passage having a hydraulic diameter greater than that of the fine flow passage, and then flows out to the outside. Therefore, the flow passage resistance can be reduced, the fluid can be made to flow at a flow rate at which the leakage can be detected, and time required to detect the leakage can thus be reduced. In addition, the number of outer flow passages can be reduced, and the outflow passage along which the fluid flows out to the outside can be easily specified. Therefore, the number of detection sensors used to detect fluid leakage can be reduced, and the cost can be reduced.

DESCRIPTION OF EMBODIMENTS

Figure 1:
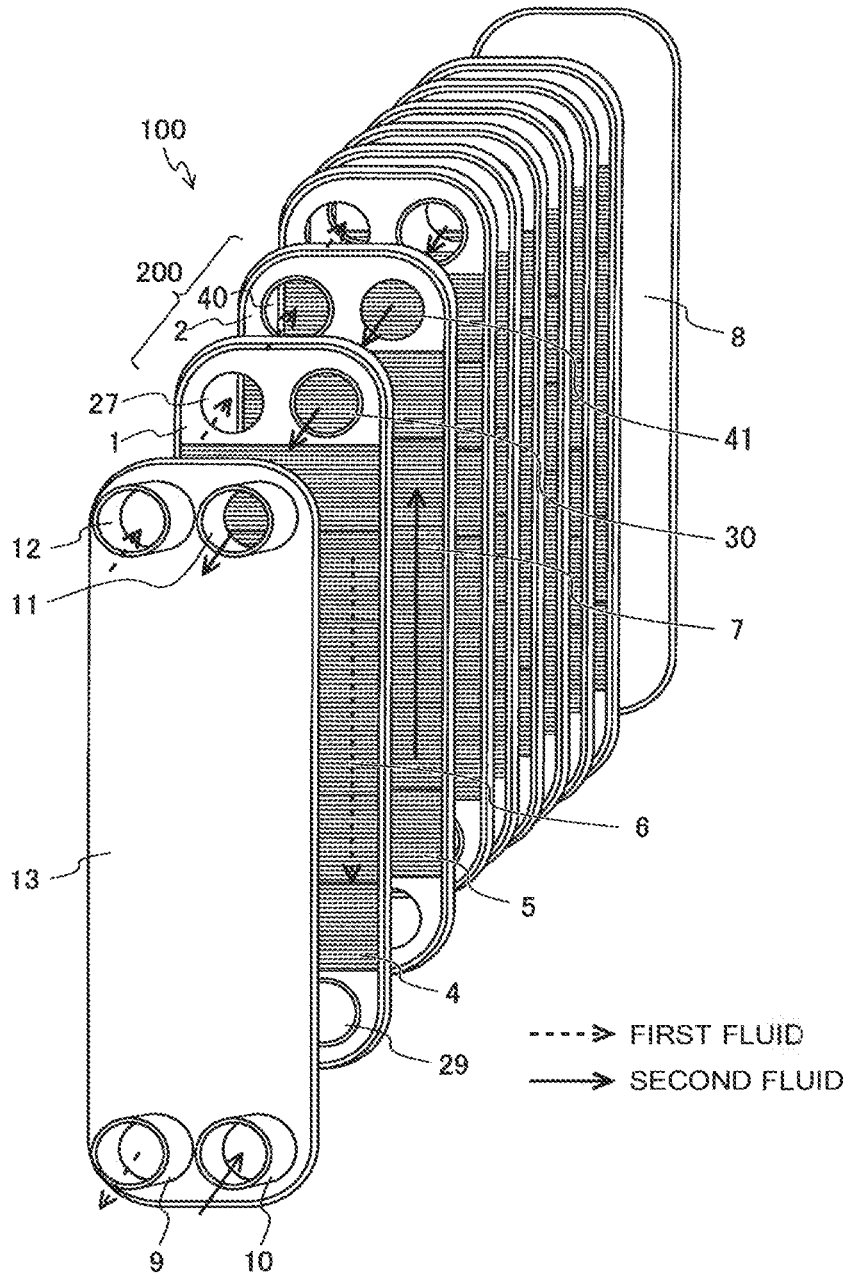
FIG. 1 is an exploded side perspective view of a plate heat exchanger according to Embodiment 1 of the present disclosure.

Embodiments of the present disclosure will be described with reference to the drawings. However, the following descriptions concerning the embodiments are not limiting. In the drawings, the relationships between the sizes of components may differ from the actual relationships.

Although terms representing directions (for example "up", "down", "right", "left", "front", "rear", etc.) are used as appropriate to facilitate understanding in the following description, these terms are used for the purpose of explanation, and are not limiting. In addition, in the embodiments described below, the terms "up", "down", "right", "left", "front", and "rear" represent directions in front view of a plate heat exchanger 100, that is, directions as the plate heat exchanger 100 is viewed in a stacking direction in which heat transfer plates 1 and 2 are stacked. In addition, with regard to the terms "recess" and "projection", a portion that projects forward will be referred to as a "projection", and a portion that projects rearward will be referred to as a "recess".

Embodiment 1

Figure 2:
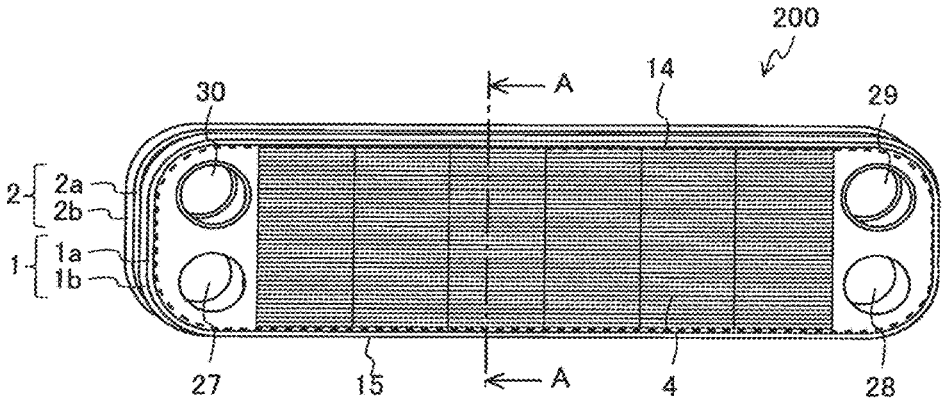
FIG. 2 is a front perspective view of a heat transfer set included in the plate heat exchanger according to Embodiment 1 of the present disclosure.
Figure 3:
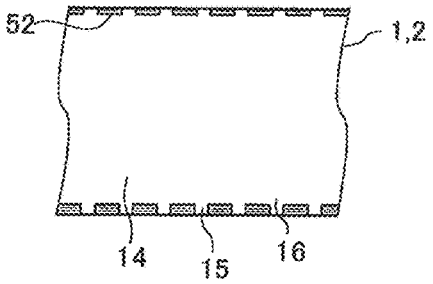
FIG. 3 is a partial schematic diagram illustrating a space between each of pairs of metal plates that form heat transfer plates included in the plate heat exchanger according to Embodiment 1 of the present disclosure.
Figure 4:
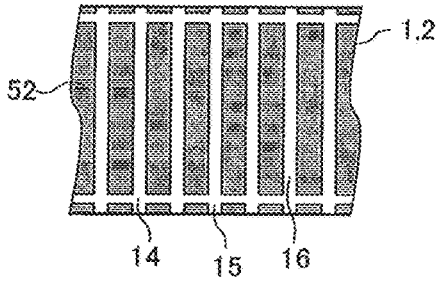
FIG. 4 is a partial schematic diagram illustrating a first modification of the space between each of the pairs of metal plates that form the heat transfer plates included in the plate heat exchanger according to Embodiment 1 of the present disclosure.
Figure 5:
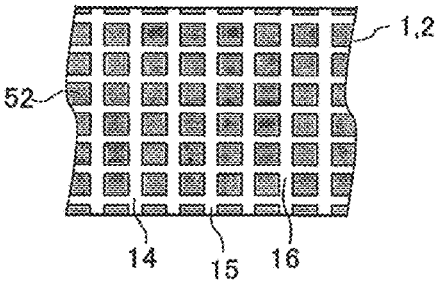
FIG. 5 is a partial schematic diagram illustrating a second modification of the space between each of the pairs of metal plates that form the heat transfer plates included in the plate heat exchanger according to Embodiment 1 of the present disclosure.
Figure 6:
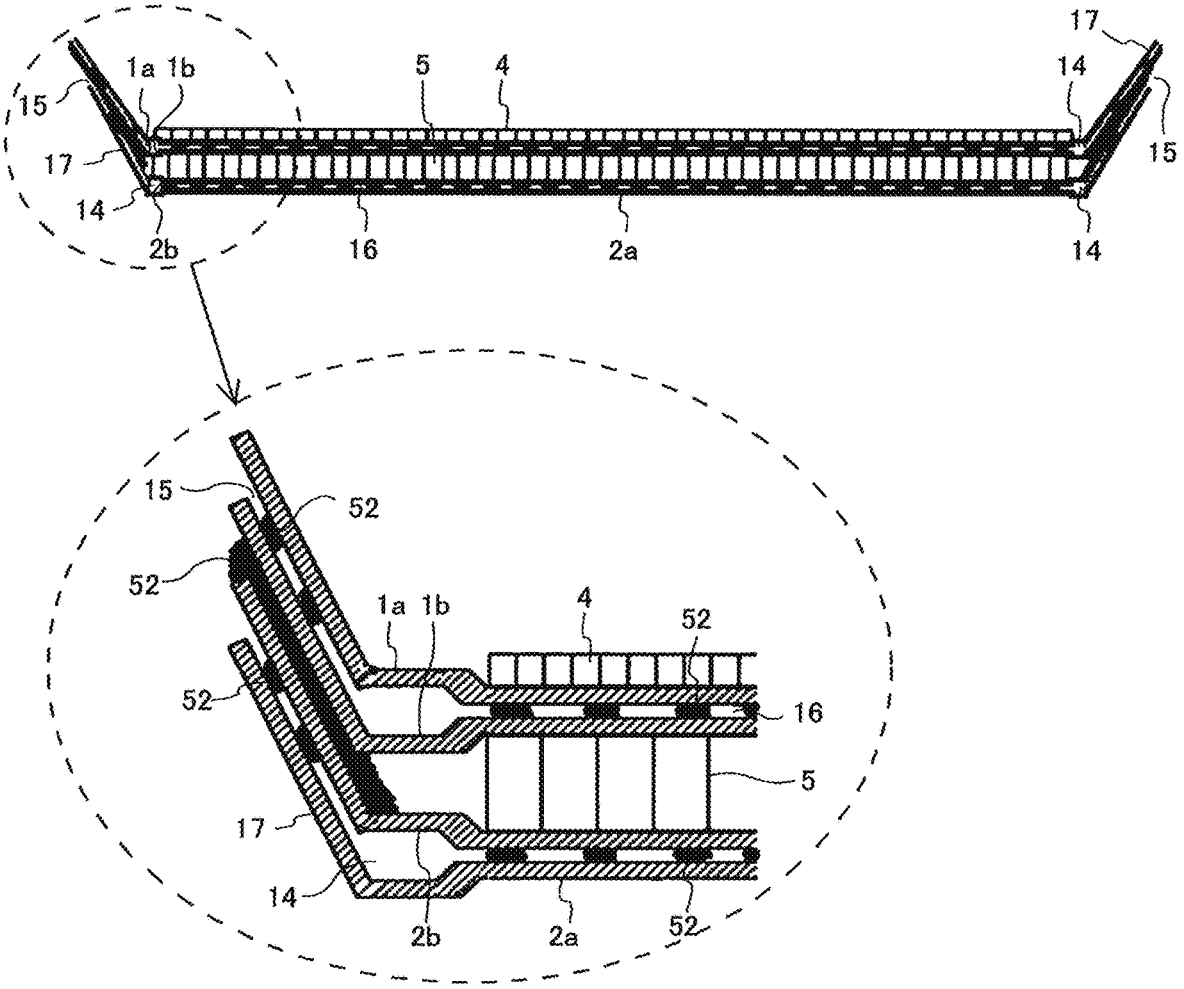
FIG. 6 is a sectional view of the heat transfer set included in the plate heat exchanger according to Embodiment 1 of the present disclosure, which is taken along line A-A in FIG. 2.

FIG. 1 is an exploded side perspective view of a plate heat exchanger 100 according to Embodiment 1 of the present disclosure. FIG. 2 is a front perspective view of a heat transfer set 200 included in the plate heat exchanger 100 according to Embodiment 1 of the present disclosure. FIG. 3 is a partial schematic diagram illustrating space between each of pairs of metal plates (1*a* and 1*b*) (2*a* and 2*b*) that form the heat transfer plates 1 and 2 included in the plate heat exchanger 100 according to Embodiment 1 of the present disclosure. FIG. 4 is a partial schematic diagram illustrating a first modification of the space between each of the pairs of metal plates (1*a* and 1*b*) (2*a* and 2*b*) that form the heat transfer plates 1 and 2 included in the plate heat exchanger 100 according to Embodiment 1 of the present disclosure. FIG. 5 is a partial schematic diagram illustrating a second modification of the space between each of the pairs of metal plates (1*a* and 1*b*) (2*a* and 2*b*) that form the heat transfer plates 1 and 2 included in the plate heat exchanger 100 according to Embodiment 1 of the present disclosure. FIG. 6 is a sectional view of the heat transfer set 200 included in the plate heat exchanger 100 according to Embodiment 1 of the present disclosure, which is taken along line A-A in FIG. 2.

In FIG. 1, dashed arrows indicate the flow of first fluid, and solid arrows indicate the flow of second fluid. In FIG. 6, blacked portions are brazed portions 52.

As illustrated in FIG. 1, the plate heat exchanger 100 according to Embodiment 1 includes a plurality of heat transfer plates 1 and 2, which are alternately stacked. As illustrated in FIGS. 1 and 2, the heat transfer plates 1 and 2 have a rectangular shape with round corners and include flat overlapping surfaces. Each of the heat transfer plates 1 and 2 has openings 27 to 30 at four corners of each heat transfer. The heat transfer plates 1 and 2 will be also correctively referred to as heat transfer sets 200. In Embodiment 1, the heat transfer plates 1 and 2 have a rectangular shape with round corners.

As illustrated in FIG. 6, the heat transfer plates 1 and 2 are brazed together at outer wall portions 17, which will be described later, and in the vicinity of the openings 27 to 30. In order to enable heat exchange to be performed between the first fluid and the second fluid, first flow passages 6 through which the first fluid flows and second flow passages 7 through which the second fluid flows are alternately arranged, with the heat transfer plates 1 and 2 alternately interposed between the first flow passages 6 and the second flow passages 7.

As illustrated in FIGS. 1 and 2, the openings 27 to 30 at the four corners are provided such that the openings 27 communicate with each other, the openings 28 communicate with each other, the openings 29 communicate with each other, and the openings 30 communicate with each other, thereby forming a first header 40 that allows the first fluid to flow into and out of the first flow passages 6 and a second header 41 that allows the second fluid to flow into and out of the second flow passages 7. To ensure sufficient fluid flow velocities and improve performance, the heat transfer plates 1 and 2 are arranged such that a direction in which the fluids flow is a longitudinal direction, that is, a direction along the long side of each transfer plate, and a direction perpendicular to the longitudinal direction is a width direction, that is, a direction along the short side of each transfer plate.

In the first flow passages 6 and the second flow passages 7, inner fins 4 and 5 are provided, respectively. The heat transfer plates 1 and 2 have double wall structures obtained by joining the pairs of metal plates (1*a* and 1*b*) (2*a* and 2*b*) together. The inner fins 4 and 5 are fins disposed between the pairs of metal plates (1*a* and 1*b*) (2*a* and 2*b*).

As illustrated in FIG. 6, the metal plates 1*a* and 2*a* (hereinafter referred to also as heat transfer plates A) are adjacent to the first flow passages 6 in which the inner fins 4 are provided, and the metal plates 1*b* and 2*b* (hereinafter referred to also as heat transfer plates B) are adjacent to the second flow passages 7 in which the inner fins 5 are provided.

The metal plates 1*a*, 1*b*, 2*a*, and 2*b* are formed of, for example, stainless steel, carbon steel, aluminum, copper, or an alloy thereof. The following description is made with respect to the case where the metal plates are formed of stainless steel.

As illustrated in FIG. 1, a first reinforcing side plate 13 having openings at four corners thereof and a second reinforcing side plate 8 are provided on outermost surfaces of the heat transfer plates 1 and 2 in the stacking direction. The first reinforcing side plate 13 and the second reinforcing side plate 8 have a rectangular shape with round corners and include flat overlapping surfaces. Referring to FIG. 1, the first reinforcing side plate 13 is located on the foremost one of the outermost surfaces, and the second reinforcing side plate 8 is located on the rearmost one of the outermost surfaces. In Embodiment 1, the first reinforcing side plate 13 and the second reinforcing side plate 8 have a rectangular shape with round corners.

In the openings in the first reinforcing side plate 13, a first inlet pipe 12, a first outlet pipe 9, a second inlet pipe 10, and a second outlet pipe 11 are provided. The first inlet pipe 12 is a pipe into which the first fluid flows, the first outlet pipe 9 is a pipe from which the first fluid flows out, the second inlet pipe 10 is a pipe into which the second fluid flows, and the second outlet pipe 11 is a pipe from which the second fluid flows out.

As illustrated in FIG. 6, the heat transfer plates 1 and 2 include outer wall portions 17 at edges of the heat transfer plates 1 and 2, the outer wall portions 17 being bent therefrom in the stacking direction.

The above first fluid is, for example, refrigerant such as R410A, R32, R290, $HFO_{MIX}$, or $CO_2$, and the above second fluid is water, an antifreeze such as ethylene glycol or propylene glycol, or a mixture thereof.

The operating pressure of the above first fluid is substantially a saturation pressure of the first fluid, and is constantly high in operation. The operating pressure of the second fluid is substantially a pump pressure that enables the second fluid to flow, and is constantly low in operation.

The heat transfer plates 1 and 2 are formed by applying an adhesion prevention material (for example, a material that contains a metal oxide as a main component and prevents flow of a brazing material) to portions of the pairs of metal plates (1*a* and 1 *b*) (2*a* and 2*b*) that are located in a heat exchange region in which the first fluid and the second fluid exchange heat, and putting a brazing sheet (brazing material) made of, for example, copper between each of the pairs of metal plates (1*a* and 1 *b*) (2*a* and 2*b*). As illustrated in FIG. 6, the metal plates 1*a*, 1 *b*, 2*a*, and 2*b* are joined together such that these plates are partially brazed at the brazed portions 52, and fine flow passages 16 are provided between the portions of the pairs of metal plates (1*a* and 1*b*) (2*a* and 2*b*) that are located in the heat exchange region.

In addition, peripheral leakage passages 14 that communicate with the fine flow passages 16 are formed between the pairs of metal plates (1*a* and 1*b*) (2*a* and 2*b*) along inner sides of the outer wall portions 17. The peripheral leakage passages 14 are disposed inward of the outer wall portions 17 and outward of the fine flow passages 16, and are formed by forming a projection or a recess on or in each of portions of the metal plates 1*a*, 1*b*, 2*a*, and 2*b* that are located inward of the outer wall portions 17 and outward of the fine flow passages 16. The peripheral leakage passages 14 may be formed to extend continuously or discontinuously.

Outer flow passages 15 that communicate with the outside are provided between the outer wall portions 17 of the pairs of metal plates (1*a* and 1*b*) (2*a* and 2*b*). The outer flow passages 15 communicate with the peripheral leakage passages 14.

The peripheral leakage passages 14 have a greater height (wider in the stacking direction) than the fine flow passages 16. The peripheral leakage passages 14 have a hydraulic diameter of 0.1 mm to 1.0 mm, and the fine flow passages 16 have a hydraulic diameter of 10 μm to 100 μm. The leakage passages 14 do not necessarily have a circular cross section, and their size is thus described above in terms of hydraulic diameter, which is a diameter of a circular tube equivalent to the leakage passages 14.

The fine flow passages 16 and the peripheral leakage passages 14 communicate with the outer flow passages 15, which communicate with the outside. Thus, fluid that has leaked flows through the fine flow passages 16 and the peripheral leakage passages 14 and then flows out to the outside through the outer flow passages 15.

As illustrated in FIG. 3, the portions of each of the pairs of metal plates (1*a* and 1 *b*) (2*a* and 2*b*) that are located in the heat exchange region may not be joined together, and the fine flow passage 16 may be formed in the entire portions located in the heat exchange region. Alternatively, as illustrated in FIG. 4, the portions of each of the pairs of metal plates (1*a* and 1*b*) (2*a* and 2*b*) that are located in the heat exchange region may be coated with the adhesion prevention material in a stripe pattern, and the brazing sheet made of, for example, copper may be put between the portions, whereby a plurality of fine flow passages 16 are formed in a stripe pattern. Alternatively, as illustrated in FIG. 5, the portions of each of the pairs of metal plates (1*a* and 1 *b*) (2*a* and 2*b*) that are located in the heat exchange region may be coated with the adhesion prevention material in a grid pattern, and the brazing sheet made of, for example, copper are put between the portions, whereby a plurality of fine flow passages 16 are formed in a grid pattern.

The outer flow passages 15 are also formed between the outer wall portions 17 by any one of the above methods. The fine flow passages 16 and the outer flow passages 15 may be formed in a pattern other than the stripe pattern or the grid pattern.

Although the metal plates 1*a*, 1*b*, 2*a*, and 2*b* and the inner fins 4 and 5 according to Embodiment 1 are made of the same metal material, the materials thereof are not limited to this, and the metal plates 1*a*, 1*b*, 2*a*, and 2*b* and the inner fins 4 and 5 may be made of different metals or clad materials.

The flows of the fluids in the plate heat exchanger 100 according to Embodiment 1 and the functions of the fine flow passages 16 and the peripheral leakage passages 14 will be described.

As illustrated in FIG. 1, the first fluid that has flowed into the first inlet pipe 12 flows into the first flow passages 6 through the first header 40. The first fluid that has flowed into the first flow passages 6 passes through the spaces between the inner fins 4 and a first outlet header (not illustrated), and flows out through the first outlet pipe 9. Similarly, the second fluid flows through the second flow passages 7. The first fluid and the second fluid exchange heat with each other through the double wall structures of the heat transfer plates 1 and 2.

The inner fins 4, which have a small height and are arranged at a small pitch, are provided in the first flow passages 6. Therefore, the diameter of the flow passages is reduced and a leading edge effect is obtained, and as a result the heat transfer performance of the first flow passages 6 can be improved. It is therefore appropriate that the first fluid, which has a lower heat transfer performance than the second fluid, is caused to flow through the first flow passages 6. This can thus compensate for the low heat transfer performance of the first fluid, and improve the performance of the plate heat exchanger 100.

In addition, since the fine flow passages 16 are formed between the pairs of metal plates (1*a* and 1*b*) (2*a* and 2*b*), even when the heat transfer plates A which are adjacent to the first flow passages 6 and in which the pressure is high and corrosion easily occurs are damaged and leakage of the first fluid that flows through the first flow passages 6 occurs, the first fluid that has leaked flows through the fine flow passages 16 and the peripheral leakage passages 14 and then flows out to the outside of the plate heat exchanger 100 through the outer flow passages 15 formed outward of the peripheral leakage passages 14. Then, the leakage of the first fluid can be detected by an externally installed detection sensor. In addition, since the heat transfer plates 1 and 2 have the double wall structures, the first fluid that has leaked does not flow toward the second fluid, thereby preventing the fluids of different types from being mixed.

In addition, since the peripheral leakage passages 14 are formed between the pairs of metal plates (1*a* and 1*b*) (2*a* and 2*b*), when leakage of the first fluid occurs, the first fluid flows from the fine flow passages 16 to the peripheral leakage passages 14. Then, the first fluid that has leaked promptly joins each other in the peripheral leakage passages 14, and flows out to the outside of the plate heat exchanger 100 through the outer flow passages 15 formed outward of the peripheral leakage passages 14.

As described above, the plate heat exchanger 100 includes the plurality of heat transfer plates 1 and 2 which each have the openings 27 to 30 at the four corners thereof, the heat transfer plates 1 and 2 having the outer wall portions 17 at the edges thereof and being stacked together. The heat transfer plates 1 and 2 are partially brazed together such that the first flow passage 6 through which the first fluid flows and the second flow passage 7 through which the second fluid flows are alternately arranged, with an associated one of the heat transfer plates 1 and 2 interposed between the first flow passage and the second flow passage. The openings 27 to 30 at the four corners are provided such that the openings at each of the four corners communicate with each other, thereby forming the first header 40 that allows the first fluid to flow into and flow out of the first flow passage and the second header 41 that allows the second fluid to flow into and flow out of the second flow passage. At least one of two of the heat transfer plates 1 and 2 between which the first flow passage 6 or the second flow passage 7 is provided is formed by staking the pair of metal plates (1*a* and 1*b*) or (2*a* and 2*b*) together. The space between the pair of metal plates (1*a* and 1*b*) or (2*a* and 2*b*) includes the fine flow passage 16 that is located within the heat exchange region in which the first fluid and the second fluid exchange heat and the peripheral leakage passage 14 provided outward of the fine flow passage 16 to communicate with the outside of the space and having a hydraulic diameter greater than that of the fine flow passage 16.

In the plate heat exchanger 100 according to Embodiment 1, between each of the pairs of metal plates (1*a* and 1*b*) (2*a* and 2*b*), the fine flow passage 16 and the peripheral leakage passage 14 are provided. The fine flow passage 16 is provided in the heat exchange region in which the first fluid and the second fluid exchange heat with each other. The peripheral leakage passage 14 is located outward of the fine flow passage 16, communicates with the outside, and has a hydraulic diameter greater than that of the fine flow passage 16. When fluid leakage occurs, the fluid that has leaked flows through the fine flow passage 16, flows in the peripheral leakage passage 14 having a hydraulic diameter greater than that of the fine flow passage 16, and then flows out to the outside. Therefore, the flow passage resistance can be reduced, whereby the fluid can be made to flow at a flow rate at which the leakage can be detected, and time required to detect the leakage can be reduced. In addition, the number of outer flow passages 15 can be reduced, and the outflow passage along which the fluid flows out to the outside can be easily specified. Therefore, the number of detection sensors for use in detection of fluid leakage can be reduced, and the cost can thus be reduced.

In the case where the metal plates 1*a*, 1 *b*, 2*a*, and 2*b* or the inner fins 4 and 5 are made of a clad material, the overall assembly process of the plate heat exchanger 100 can be simplified, and the manufacturing cost can be reduced.

In Embodiment 1, although the first fluid and the second fluid are caused to flow in a counter-flow manner, the flowing manner thereof is not limited to this, and the first fluid and the second fluid may be caused to flow in a parallel flow manner.

Embodiment 2

Embodiment 2 of the present disclosure will be described. Regarding Embodiment 2, descriptions of components that are same as those in Embodiment 1 will not be made, and components that are the same as or equivalent to those in Embodiment 1 will be denoted by the same reference signs.

Figure 7:
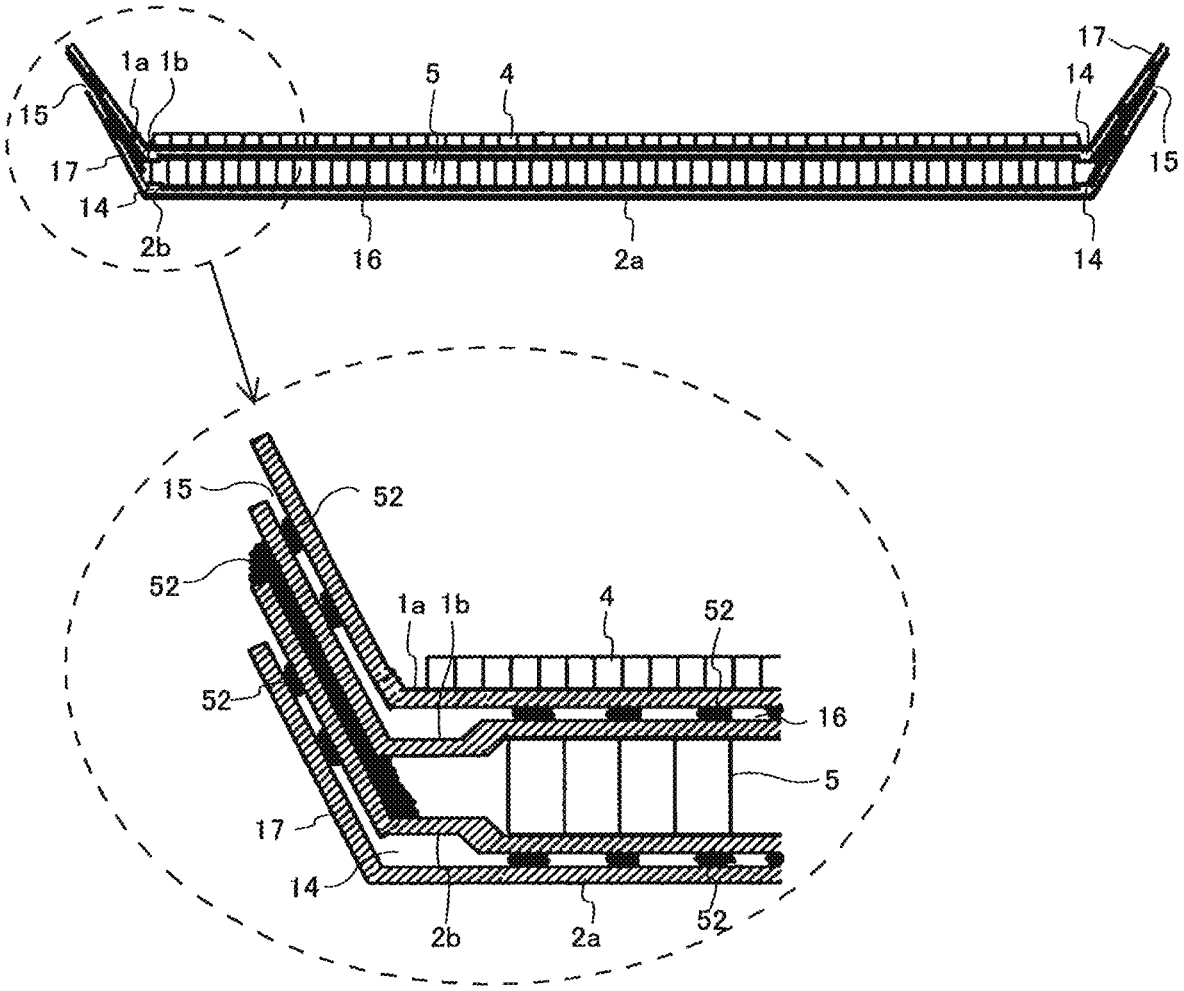
FIG. 7 is a sectional view of a heat transfer set included in a plate heat exchanger according to Embodiment 2 of the present disclosure.

FIG. 7 is a sectional view of a heat transfer set 200 included in a plate heat exchanger 100 according to Embodiment 2 of the present disclosure. FIG. 7 corresponds to FIG. 6 related to Embodiment 1.

As illustrated in FIG. 7, in the plate heat exchanger 100 according to Embodiment 2, portions of the metal plates 1*b* and 2*b* that are located inward of the outer wall portions 17 and outward of the fine flow passages 16 are each processed to have a projection or a recess. Portions of the metal plates 1*a* and 2*a* that are located inward of the outer wall portions 17 and outward of the fine flow passages 16 do not have a projection or a recess.

In other words, in Embodiment 2, the peripheral leakage passages 14 are formed between the pairs of metal plates (1*a* and 1*b*) (2*a* and 2*b*) by forming projections or recesses on or in only one of the metal plates 1*a* and 1*b* and only one of the metal plates 2*a* and 2*b*.

In such a manner, the peripheral leakage passages 14 are formed between the metal plates 1*a* and 1*b* and between the metal plates 2*a* and 2*b* by forming projections or recesses on or in only one of the metal plates 1*a* and 1 *b* and only one of the metal plates 2*a* and 2*b*. Accordingly, the number of processes that are performed on the metal plates 1*a*, 1 *b*, 2*a*, and 2*b* can be reduced, and the manufacturing cost can be reduced.

Embodiment 3

Embodiment 3 of the present disclosure will be described. Regarding Embodiment 2, descriptions of components that are same as those in Embodiment 1 and/or Embodiment 2 will not be made, and components that are the same as or equivalent to those in Embodiment 1 and/or Embodiment 2 will be denoted by the same reference signs.

Figure 8:
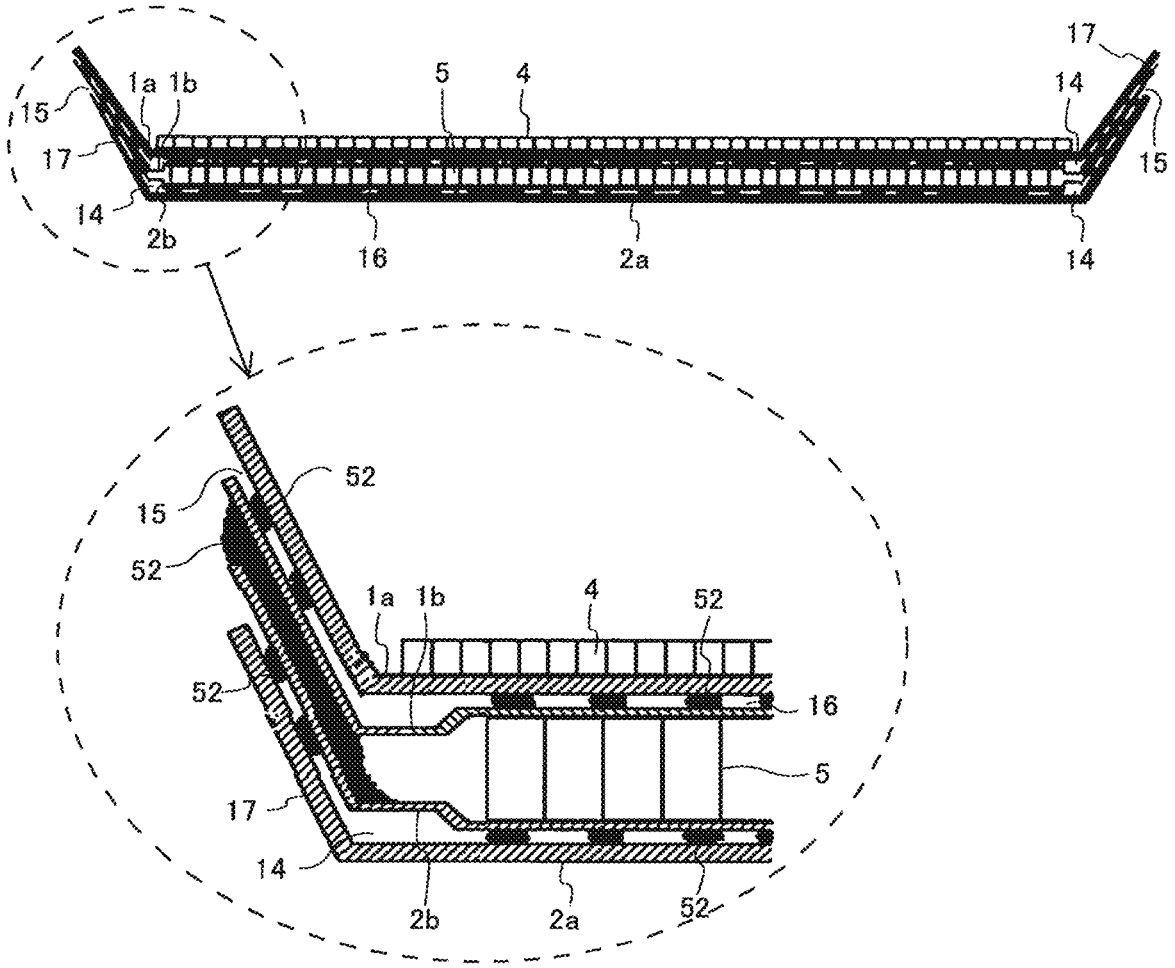
FIG. 8 is a sectional view of a heat transfer set included in a plate heat exchanger according to Embodiment 3 of the present disclosure.

FIG. 8 is a sectional view of a heat transfer set 200 included in a plate heat exchanger 100 according to Embodiment 3 of the present disclosure. FIG. 8 corresponds to FIG. 6 related to Embodiment 1.

As illustrated in FIG. 8, in the plate heat exchanger 100 according to Embodiment 3, the heat transfer plates B have a thickness different from that of the heat transfer plates A, and are thinner than the heat transfer plates A.

In such a manner, since the heat transfer plates B are thinner than the heat transfer plates A, even if the second fluid, such as water, that flows through the second flow passages 7 freezes, the second fluid leaks first from the heat transfer plates B, which are thinner than the heat transfer plates A. Therefore, by detecting leakage of the second fluid with the externally installed detection sensor, it is possible to prevent leakage of the first fluid, which is refrigerant such as R410A, R32, R290, $HFO_{MIX}$, or $CO_2$.

In addition, by reducing the thickness of the heat transfer plates B, the efficiency of heat exchange between the first fluid and the second fluid is increased, whereby the heat exchange performance of the plate heat exchanger 100 can be improved, and the manufacturing cost can be reduced.

Embodiment 4

Embodiment 4 of the present disclosure will be described. Regarding Embodiment 4, descriptions of components that are the same as those in any of Embodiments 1 to 3 will not be made, and components that are the same as or equivalent to those in Embodiments 1 to 3 will be denoted by the same reference signs.

Figure 9:
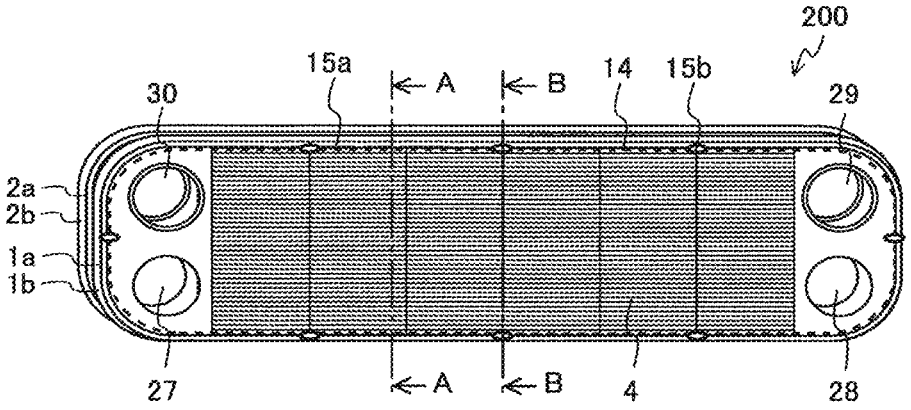
FIG. 9 is a front perspective view of a heat transfer set included in a plate heat exchanger according to Embodiment 4 of the present disclosure.
Figure 10:
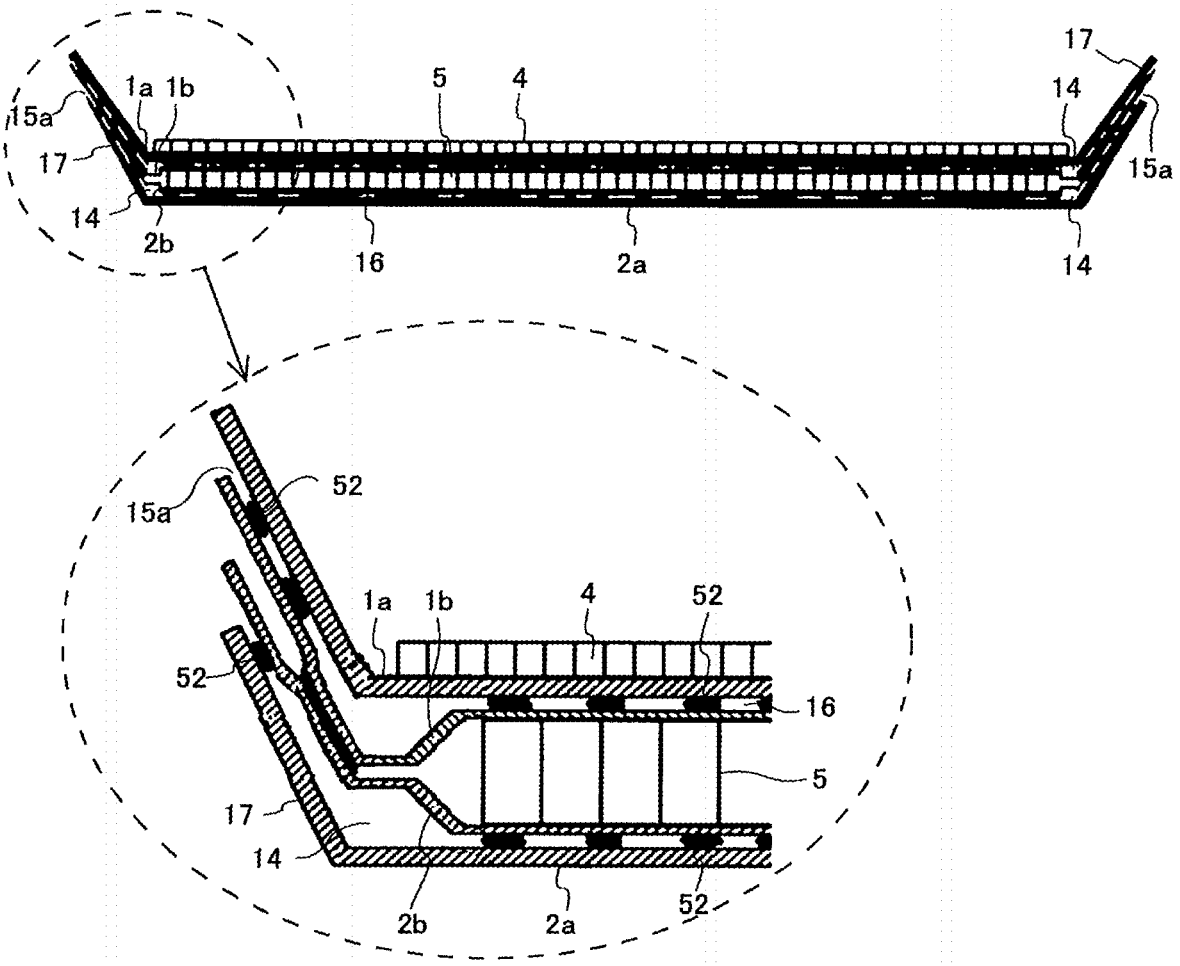
FIG. 10 is a sectional view of the heat transfer set included in the plate heat exchanger according to Embodiment 4 of the present disclosure, which is taken along line A-A in FIG. 9.
Figure 11:
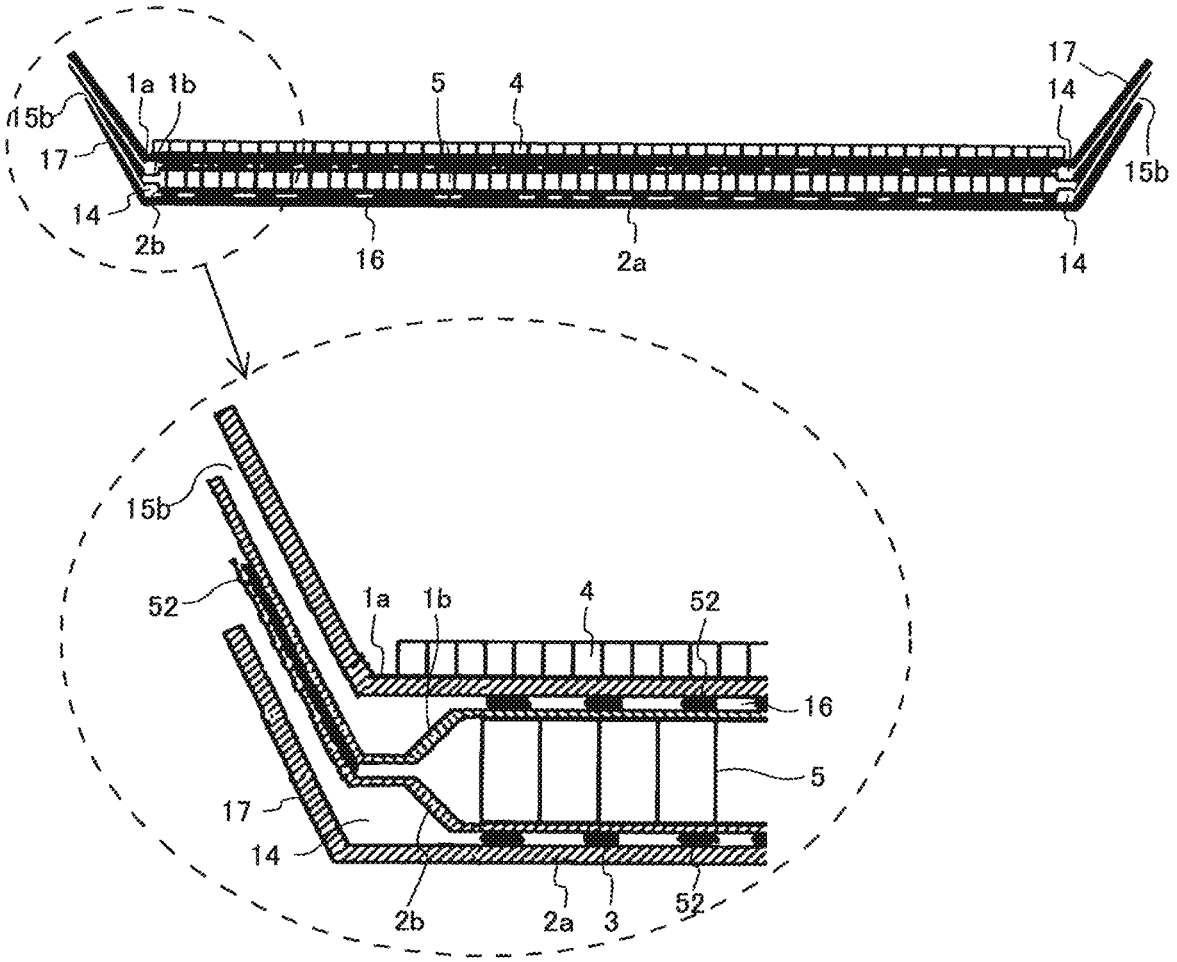
FIG. 11 is a sectional view of the heat transfer set included in the plate heat exchanger according to Embodiment 4 of the present disclosure, which is taken along line B-B in FIG. 9.

FIG. 9 is a front perspective view of a heat transfer set 200 included in a plate heat exchanger 100 according to Embodiment 4 of the present disclosure. FIG. 10 is a sectional view of the heat transfer set 200 included in the plate heat exchanger 100 according to Embodiment 4 of the present disclosure, which is taken along line A-A in FIG. 9. FIG. 11 is a sectional view of the heat transfer set 200 included in the plate heat exchanger 100 according to Embodiment 4 of the present disclosure, which is taken along line B-B in FIG. 9.

As illustrated in FIGS. 9 to 11, in the plate heat exchanger 100 according to Embodiment 4, outer flow passages 15*a* and 15*b* are formed between the outer wall portions 17 of the pairs of metal plates (1*a* and 1*b*) (2*a* and 2*b*). The outer flow passages 15*a* are not connected with the outside, and the outer flow passages 15*b* are connected with the outside. Thus, only some of the outer flow passages 15*a* and 15*b* are connected with the outside. The outer flow passages 15*a* that are not connected with the outside communicate with the outer flow passages 15*b* that are connected with the outside.

Since only the outer flow passages 15*b* are connected with the outside as described above, when fluid leakage occurs, the fluid that has leaked flows through the fine flow passages 16, joins each other in the peripheral leakage passages 14 having a hydraulic diameter greater than that of the fine flow passages 16, and then flows out to the outside through the outer flow passages 15*b*. Therefore, the fluid can be made to flow at a flow rate at which the leakage can be detected, and time required to detect the leakage can be reduced. In addition, the outflow passage along which the fluid flows out to the outside can be easily specified, whereby the number of detection sensors that detect fluid leakage can be reduced, and the cost can be reduced. In addition, since a plurality of outer flow passages, that is, the outer flow passages 15*b*, are connected with the outside, even when some of the outer flow passages 15*b* are clogged, the fluid can be made to flow out to the outside through the other outer flow passages 15*b*.

Embodiment 5

Embodiment 5 of the present disclosure will be described. Regarding Embodiment 5, descriptions of components that are the same as those in any of Embodiments 1 to 4 will be made, and components that are the same as or equivalent to o those in Embodiments 1 to 4 will be denoted by the same reference signs.

Figure 12:
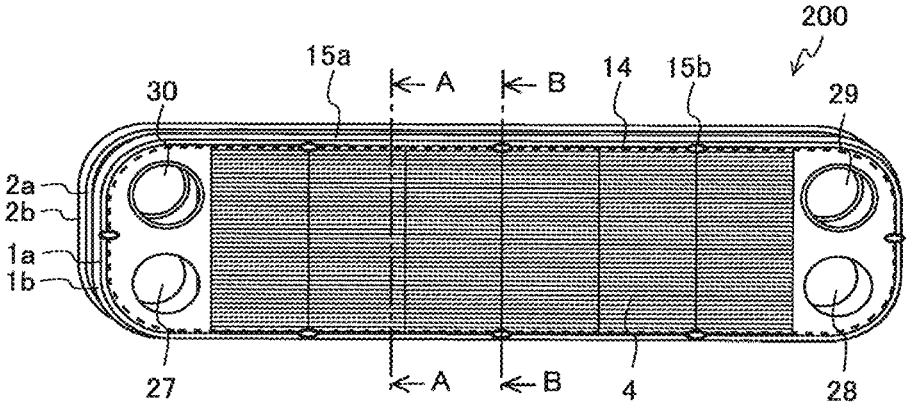
FIG. 12 is a front perspective view of a heat transfer set included in a plate heat exchanger according to Embodiment 5 of the present disclosure.
Figure 13:
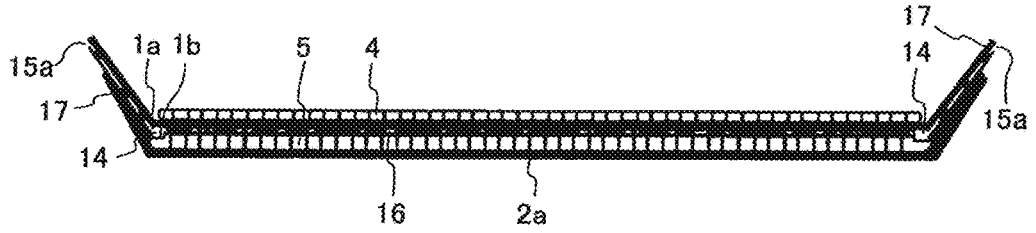
FIG. 13 is a sectional view of the heat transfer set included in the plate heat exchanger according to Embodiment 5 of the present disclosure, which is taken along line A-A in FIG. 12.
Figure 14:
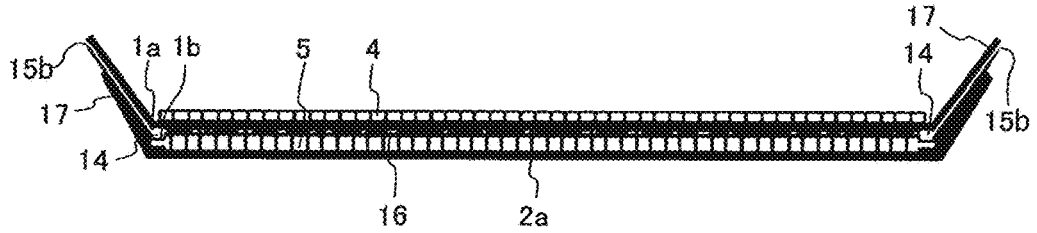
FIG. 14 is a sectional view of the heat transfer set included in the plate heat exchanger according to Embodiment 5 of the present disclosure, which is taken along line B-B in FIG. 12.

FIG. 12 is a front perspective view of a heat transfer set 200 included in a plate heat exchanger 100 according to Embodiment 5 of the present disclosure. FIG. 13 is a sectional view of the heat transfer set 200 included in the plate heat exchanger 100 according to Embodiment 5 of the present disclosure, which is taken along line A-A in FIG. 12. FIG. 14 is a sectional view of the heat transfer set 200 included in the plate heat exchanger 100 according to Embodiment 5 of the present disclosure, which is taken along line B-B in FIG. 12.

As illustrated in FIGS. 12 to 14, in the plate heat exchanger 100 according to Embodiment 5, each of heat transfer plates 1 is formed to include a pair of metal plates 1*a* and 1 *b*, and each of heat transfer plates 2 is formed to include a single metal plate 2*a*. The metal plates 1*a* and 2*a* have a thickness different from that of the metal plate 1*b*, and the metal plate 1*b* is thinner than the metal plates 1*a* and 2*a*.

Part of the thinner metal plate 1*b* that is located inward of the outer wall portions 17 and outward of the fine flow passage 16 is processed to have a projection that projects toward the second flow passage 7. Part of the other metal plate 1*a* that is located inward of the outer wall portions 17 and outward of the fine flow passage 16 is not processed to have a projection. Thus, the peripheral leakage passage 14 is provided between the metal plates 1*a* and 1*b* in such a manner as to have a projection only on the metal plate 1*b*. In addition, the outer flow passages 15*a* and 15*b* are formed between the outer wall portions 17 of the pair of metal plates 1*a* and 1 *b*. The outer flow passages 15*a* are not connected with the outside, and the outer flow passages 15*b* are connected with the outside. Thus, only some of the outer flow passages 15*a* and 15*b* are connected with the outside.

Figure 15:
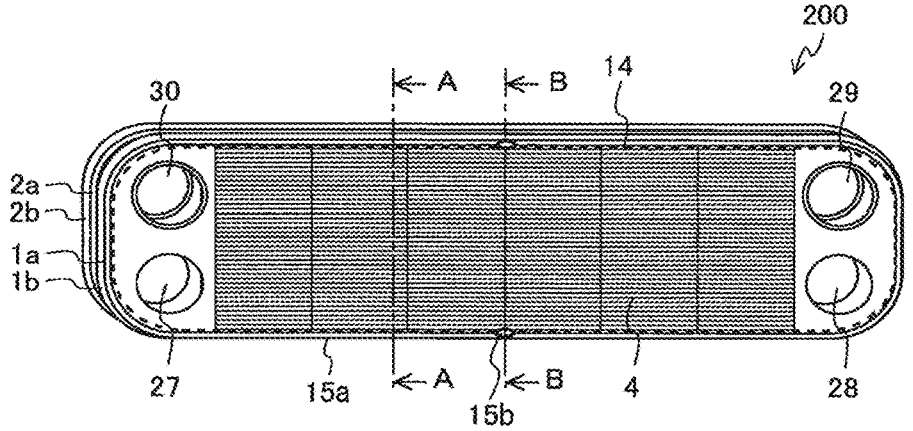
FIG. 15 is a front perspective view of a heat transfer set included in a modification of the plate heat exchanger according to Embodiment 5 of the present disclosure.
Figure 16:
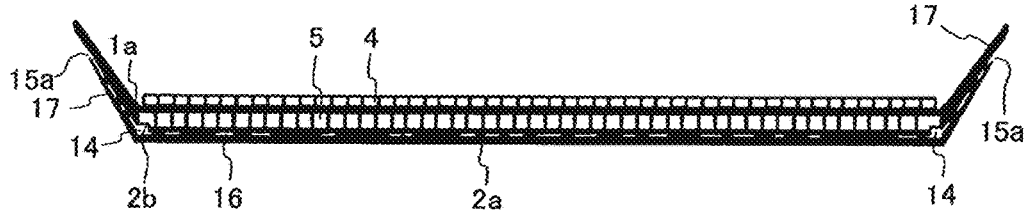
FIG. 16 is a sectional view of the heat transfer set included in the modification of the plate heat exchanger according to Embodiment 5 of the present disclosure, which is taken along line A-A in FIG. 15.
Figure 17:
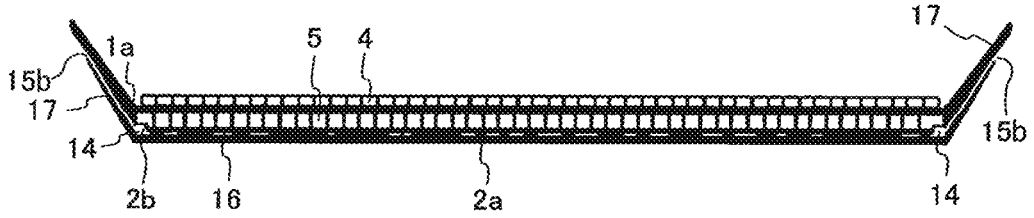
FIG. 17 is a sectional view of the heat transfer set included in the modification of the plate heat exchanger according to Embodiment 5 of the present disclosure, which is taken along line B-B in FIG. 15.

FIG. 15 is a front perspective view of a heat transfer set 200 included in a modification of the plate heat exchanger 100 according to Embodiment 5 of the present disclosure. FIG. 16 is a sectional view of the heat transfer set 200 included in the modification of the plate heat exchanger 100 according to Embodiment 5 of the present disclosure, which is taken along line A-A in FIG. 15. FIG. 17 is a sectional view of the heat transfer set 200 included in the modification of the plate heat exchanger 100 according to Embodiment 5 of the present disclosure, which is taken along line B-B in FIG. 15.

As illustrated in FIGS. 15 to 17, in the modification of the plate heat exchanger 100 according to Embodiment 5, each of the heat transfer plates 2 includes a pair of metal plates 2*a* and 2*b*, and each of the heat transfer plates 1 includes a single metal plate 1*a*. The metal plates 1*a* and 2*a* have a thickness different from that of the metal plate 2*b*, and the metal plate 2*b* is thinner than the metal plates 1*a* and 2*a*.

Part of the metal plate 2*b* that is located inward of the outer wall portions 17 and outward of the fine flow passage 16 is processed to have a projection that projects toward the second flow passage 7. Part of the other metal plate 2*a* that is located inward of the outer wall portions 17 and outward of the fine flow passage 16 is not processed to have a projection. Thus, the peripheral leakage passage 14 is formed between the metal plates 2*a* and 2*b* in such a manner as to have a projection only on the metal plate 2*b*. In addition, the outer flow passages 15*a* and 15*b* are formed between the outer wall portions 17 of the pair of metal plates 2*a* and 2*b*. The outer flow passages 15*a* are not connected with the outside, and the outer flow passages 15*b* are connected with the outside. Thus, only some of the outer flow passages 15*a* and 15*b* are connected with the outside.

By making the metal plates 1*b* and 2*b* thinner than the metal plates 1*a* and 2*a* as described above, even when the second fluid, such as water, that flows through the second flow passages 7 freezes, leakage from the metal plates 1*b* and 2*b*, which are thinner than the metal plates 1*a* and 2*a*, occurs first. Therefore, by detecting leakage of the second fluid with the externally installed detection sensor, leakage of the first fluid, which is refrigerant such as R410A, R32, R290, $HFO_{MIX}$, or $CO_2$, can be prevented.

In addition, by making the metal plates 1*b* and 2*b* have a small thickness, the efficiency of heat exchange between the first fluid and the second fluid is increased.

Thus, the heat exchange performance of the plate heat exchanger 100 can be improved, and the manufacturing cost can be reduced.

Only the outer flow passages 15*b* are connected with the outside as described above. Thus, if a fluid leakage occurs, fluid flows through the fine flow passages 16, joins each other in the peripheral leakage passages 14 having a hydraulic diameter greater than that of the fine flow passages 16, and then flows out to the outside through the outer flow passages 15*b*. Therefore, the fluid can be made to flow at a flow rate at which the leakage can be detected, and time required to detect the leakage can be reduced. In addition, the outflow passage along which the fluid flows out to the outside can be easily specified, whereby the number of detection sensors that detect fluid leakage can be reduced, and the cost can be reduced. In addition, since a plurality of outer flow passages 15*b* are connected with the outside, even when some of the outer flow passages 15*b* are clogged, the fluid can be made to flow out to the outside through the other outer flow passages 15*b*.

One of the heat transfer plates 1 and 2 includes a single metal plate 1*a* or 2*a*, and the peripheral leakage passage 14 is formed between the metal plates 1*a* and 1*b* in such a manner as to have a projection on only one of the metal plates 1*a* and 1 *b* or between the metal plates 2*a* and 2*b* in such a manner as to have a projection on only one of the metal plates 2*a* and 2*b*. Accordingly, the number of processes that are performed on the metal plates 1*a*, 1*b*, 2*a*, and 2*b* can be reduced, and the manufacturing cost can be reduced accordingly.

Embodiment 6

Embodiment 6 of the present disclosure will be described. Regarding Embodiment 6, descriptions of components that are same as those in any of Embodiments 1 to 5 will not be made, and components that are the same as or equivalent to those in any of Embodiments 1 to 5 will be denoted by the same reference signs.

Figure 18:
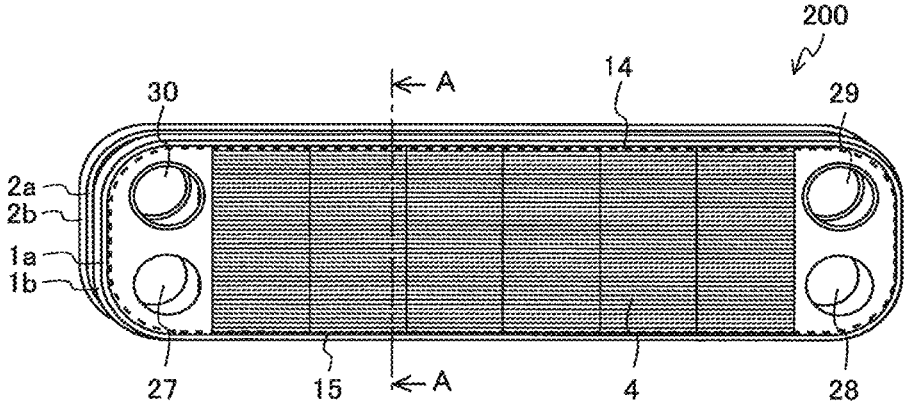
FIG. 18 is a front perspective view of a heat transfer set included in a plate heat exchanger according to Embodiment 6 of the present disclosure.
Figure 19:
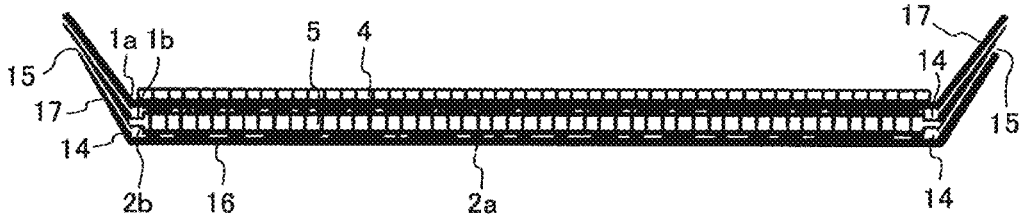
FIG. 19 is a sectional view of the heat transfer set included in the plate heat exchanger according to Embodiment 6 of the present disclosure, which is taken along line A-A in FIG. 18.

FIG. 18 is a front perspective view of a heat transfer set 200 included in a plate heat exchanger 100 according to Embodiment 6 of the present disclosure. FIG. 19 is a sectional view of the heat transfer set 200 included in the plate heat exchanger 100 according to Embodiment 6 of the present disclosure, which is taken along line A-A in FIG. 18.

As illustrated in FIGS. 18 and 19, in the plate heat exchanger 100 according to Embodiment 6, the outer wall portions 17 of the pair of metal plates 1*b* and 2*b* are brazed together, whereas the outer wall portions 17 of each of the pairs of metal plates (1*a* and 1*b*) (2*a* and 2*b*) are not brazed together. Therefore, an outer flow passage 15, which is connected with the outside, is provided in the entire space between the outer wall portions 17 of each of the pairs of metal plates (1*a* and 1*b*) (2*a* and 2*b*).

In such a manner, since the outer flow passage 15 connected with the outside is provided in the entire space between the outer wall portions 17 of each of the pairs of metal plates (1*a* and 1*b*) (2*a* and 2*b*), the outer flow passage 15 can be prevented from being clogged by brazing material that is provided between the outer wall portions 17 and that accumulates at the bottom of the outer wall portions 17.

Embodiment 7

Regarding Embodiment 7, descriptions of components that are same as those in any of Embodiments 1 to 6 will not be made, and components that are the same as or equivalent to those in any of Embodiments 1 to 6 will be denoted by the same reference signs.

Figure 20:
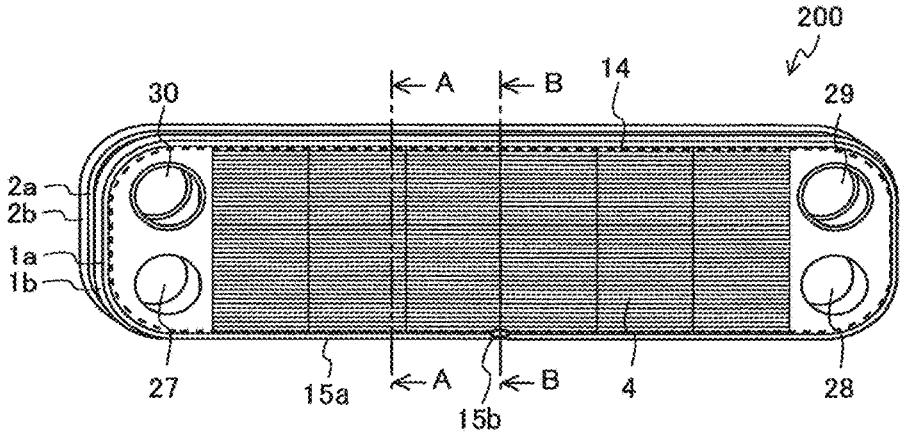
FIG. 20 is a front perspective view of a heat transfer set included in a plate heat exchanger according to Embodiment 7 of the present disclosure.
Figure 21:
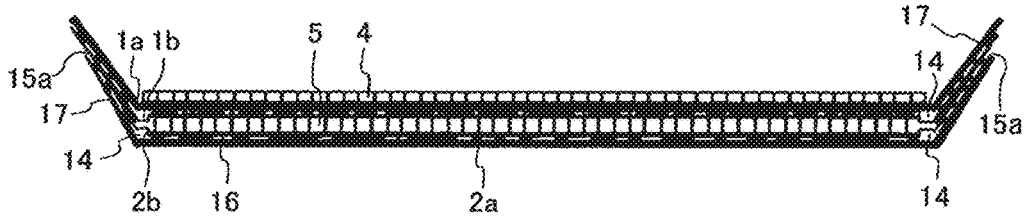
FIG. 21 is a sectional view of the heat transfer set included in the plate heat exchanger according to Embodiment 7 of the present disclosure, which is taken along line A-A in FIG. 20.
Figure 22:
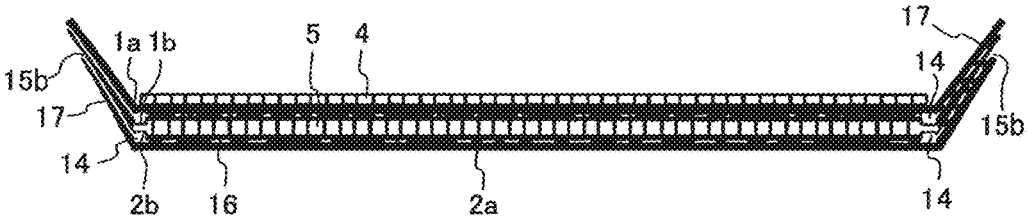
FIG. 22 is a sectional view of the heat transfer set included in the plate heat exchanger according to Embodiment 7 of the present disclosure, which is taken along line B-B in FIG. 20.

FIG. 20 is a front perspective view of a heat transfer set 200 included in a plate heat exchanger 100 according to Embodiment 7 of the present disclosure. FIG. 21 is a sectional view of the heat transfer set 200 included in the plate heat exchanger 100 according to Embodiment 7 of the present disclosure, which is taken along line A-A in FIG. 20. FIG. 22 is a sectional view of the heat transfer set 200 included in the plate heat exchanger 100 according to Embodiment 7 of the present disclosure, which is taken along line B-B in FIG. 20.

As illustrated in FIGS. 20 to 22, in the plate heat exchanger 100 according to Embodiment 7, outer flow passages 15*a* and 15*b* are formed between the outer wall portions 17 of each of the pairs of metal plates (1*a* and 1*b*) (2*a* and 2*b*). The outer flow passages 15*a* are not connected with the outside. One of the outer flow passages 15*b* is connected with the outside. That is, the number of outer flow passages 15*b* connected with the outside is only one. The outer flow passages 15*a* not connected with the outside communicate with the outer flow passage 15*b* connected with the outside.

Since only one outer flow passage 15*b* is connected with the outside as described above, if a fluid leakage occurs, fluid flows through the fine flow passages 16, joins each other in the peripheral leakage passages 14 having a hydraulic diameter greater than that of the fine flow passages 16, and then flows out to the outside through the above only one outer flow passage 15*b*. Therefore, the fluid can be made to flow at a flow rate at which the leakage can be detected, and time required to detect the leakage can be reduced. In addition, as the outflow passage along which the fluid flows out to the outside, only one passage can be specified, and the number of detection sensors that detect a fluid leakage can thus be reduced to one. Accordingly, the cost can be reduced.

Embodiment 8

Regarding Embodiment 8, descriptions of components that are same as those in any of Embodiments 1 to 7 will not be made, and components that are the same as or equivalent to those in any of Embodiments 1 to 7 will be denoted by the same reference signs.

Figure 23:
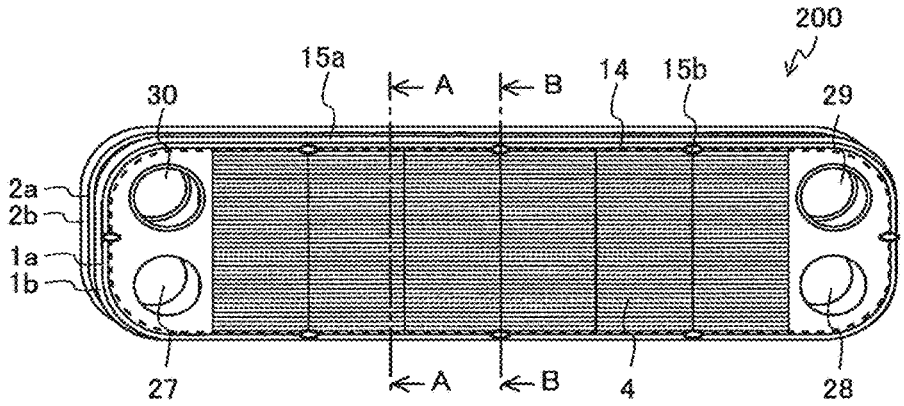
FIG. 23 is a front perspective view of a heat transfer set included in a plate heat exchanger according to Embodiment 8 of the present disclosure.
Figure 24:
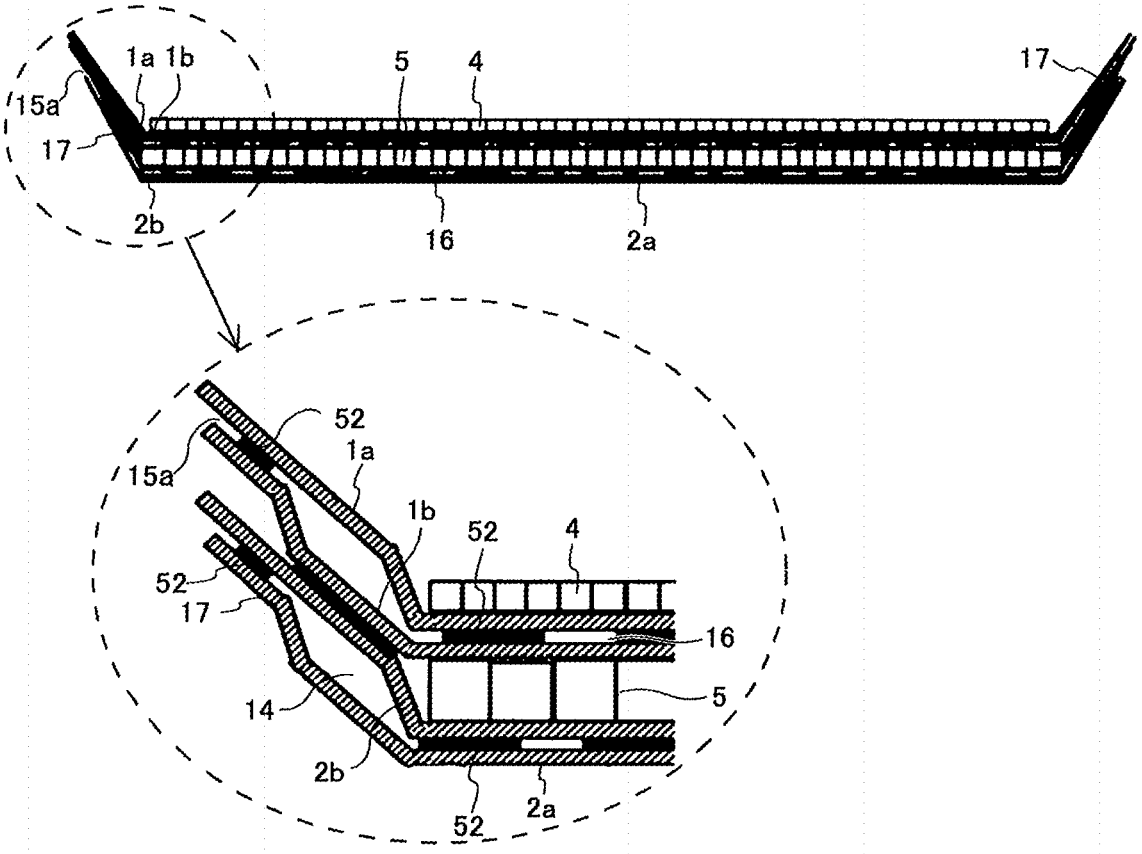
FIG. 24 is a sectional view of the heat transfer set included in the plate heat exchanger according to Embodiment 8 of the present disclosure, which is taken along line A-A in FIG. 23.
Figure 25:
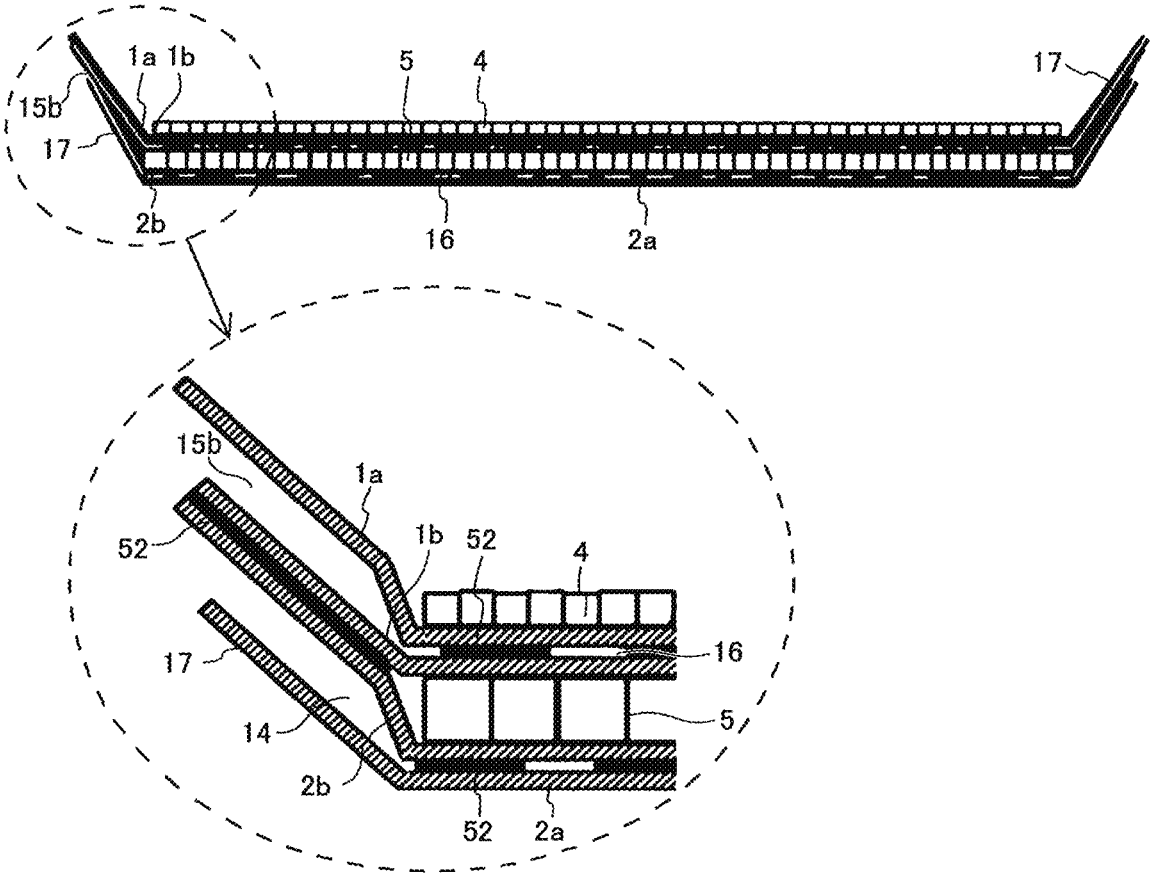
FIG. 25 is a sectional view of the heat transfer set included in the plate heat exchanger according to Embodiment 8 of the present disclosure, which is taken along line B-B in FIG. 23.
Figure 26:
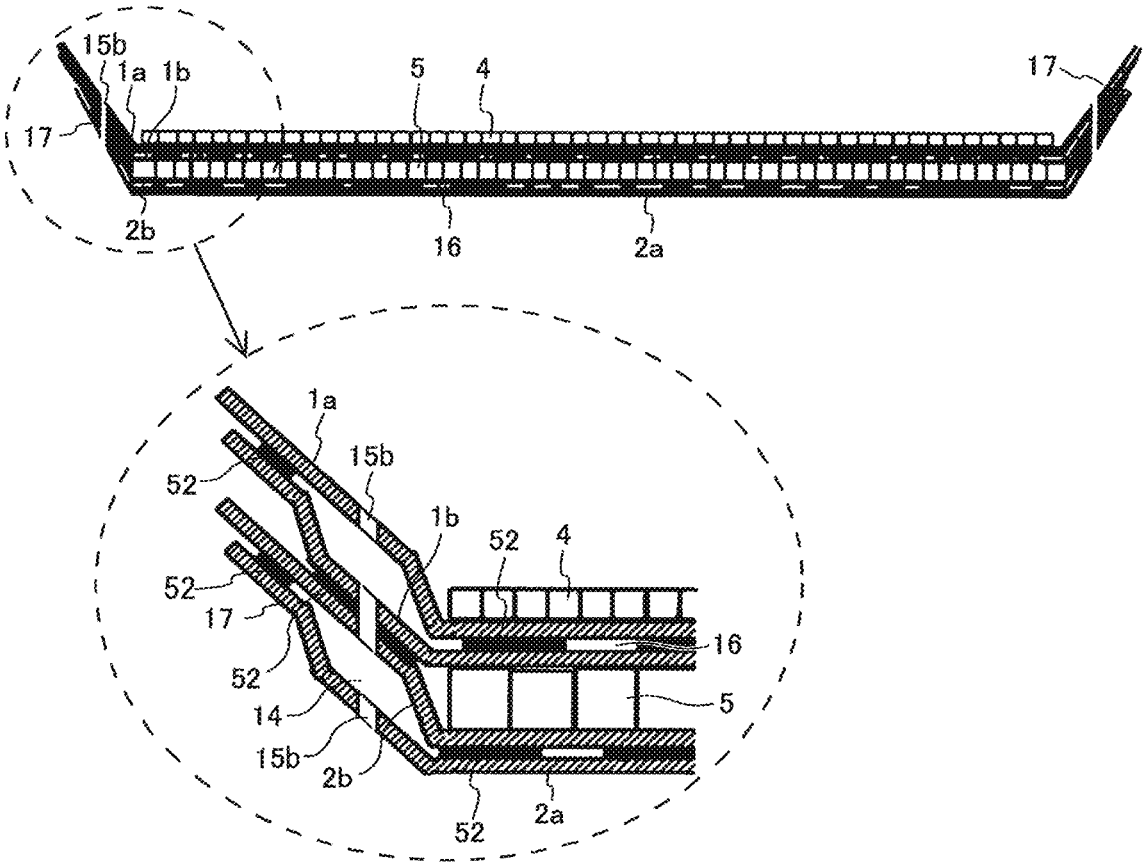
FIG. 26 is a sectional view of a heat transfer set included in a modification of the plate heat exchanger according to Embodiment 8 of the present disclosure.

FIG. 23 is a front perspective view of a heat transfer set 200 included in a plate heat exchanger 100 according to Embodiment 8 of the present disclosure. FIG. 24 is a sectional view of the heat transfer set 200 included in the plate heat exchanger 100 according to Embodiment 8 of the present disclosure, which is taken along line A-A in FIG. 23. FIG. 25 is a sectional view of the heat transfer set 200 included in the plate heat exchanger 100 according to Embodiment 8 of the present disclosure, which is taken along line B-B in FIG. 23. FIG. 26 is a sectional view of a heat transfer set 200 included in a modification of the plate heat exchanger 100 according to Embodiment 8 of the present disclosure. FIG. 26 corresponds to FIG. 25 related to Embodiment 8.

As illustrated in FIGS. 23 to 25, in the plate heat exchanger 100 according to Embodiment 8, the peripheral leakage passages 14 are formed in such a manner as to have projections or recesses on or in the outer wall portions 17 of the metal plates 1*a*, 1*b*, 2*a*, and 2*b*. Thus, the peripheral leakage passages 14 are formed between the outer wall portions 17 of the pairs of metal plates (1*a* and 1*b*) (2*a* and 2*b*). The peripheral leakage passages 14 formed between the outer wall portions 17 have a greater flow passage width (flow passage cross section) than the peripheral leakage passages 14 formed along the inner sides of the outer wall portions 17.

In addition, the outer flow passages 15*a* and 15*b* are formed between the outer wall portions 17 of each of the pairs of metal plates (1*a* and 1*b*) (2*a* and 2*b*). The outer flow passages 15*a* are not connected with the outside, and the outer flow passages 15*b* are connected with the outside. Thus, only some of the outer flow passages 15*a* and 15*b* are connected with the outside. The outer flow passages 15*a* not connected with the outside communicate with the outer flow passages 15*b* connected with the outside.

As illustrated in FIG. 26, the outer flow passages 15*b* may be formed by forming through holes that extend through the outer wall portions 17 of the metal plates 1*a*, 1*b*, 2*a*, and 2*b* in the stacking direction.

By providing the peripheral leakage passages 14 between the outer wall portions 17, which do not greatly contribute to heat transfer, the peripheral leakage passages 14 can be designed to have a great flow passage width (flow passage cross section), and the fluid can be made to flow at a flow rate at which the leakage can be detected. Therefore, the time required to detect the leakage can be reduced, while maintaining the heat transfer performance of the plate heat exchanger 100.

Embodiment 9

Embodiment 9 of the present disclosure will be described. Regarding Embodiment 9, descriptions of components that are same as those in any of Embodiments 1 to 8 will not be made, and components that are the same as or equivalent to those in any of Embodiments 1 to 8 will be denoted by the same reference signs.

Figure 27:
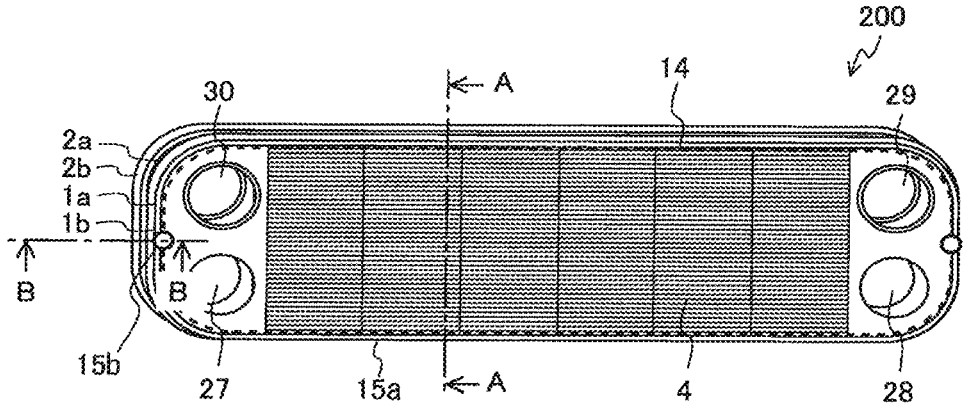
FIG. 27 is a front perspective view of a heat transfer set included in a plate heat exchanger according to Embodiment 9 of the present disclosure.
Figure 28:
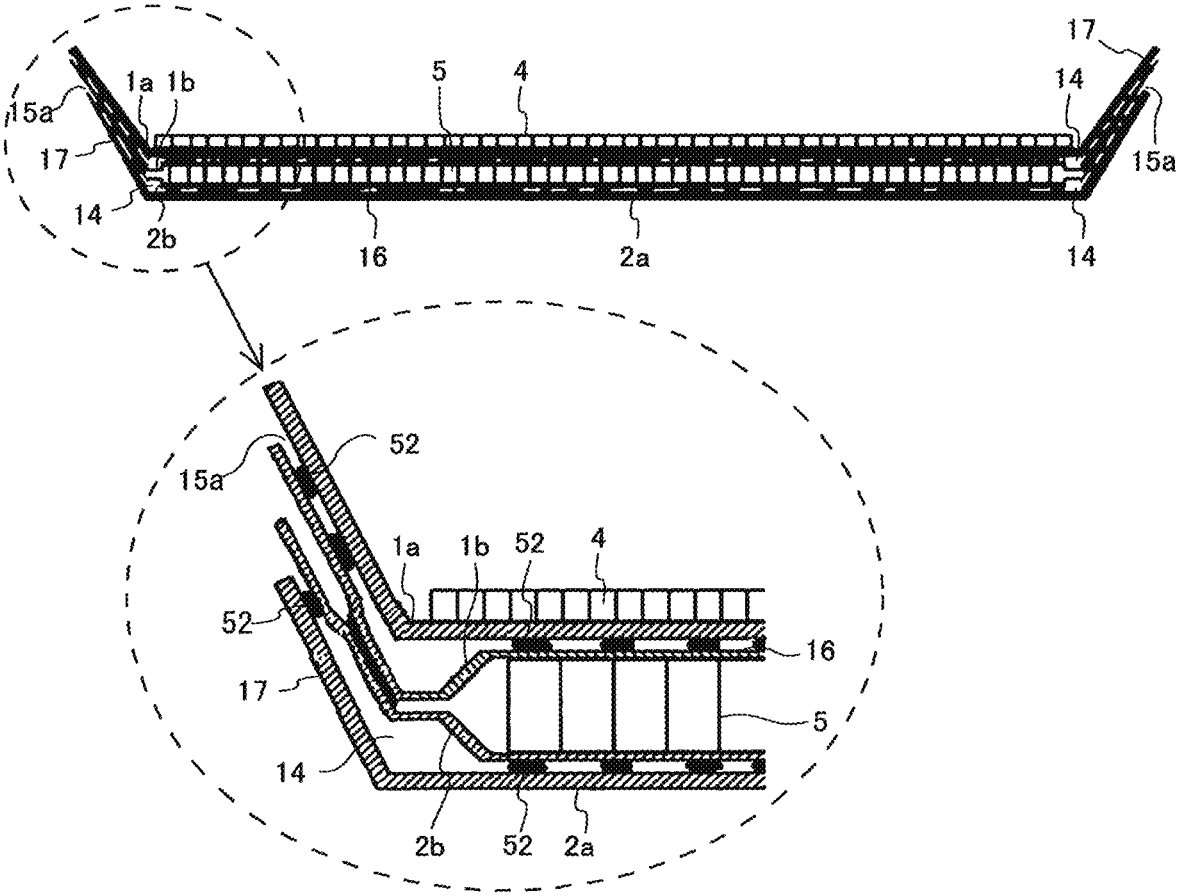
FIG. 28 is a sectional view of the heat transfer set included in the plate heat exchanger according to Embodiment 9 of the present disclosure, which is taken along line A-A in FIG. 27.
Figure 29:
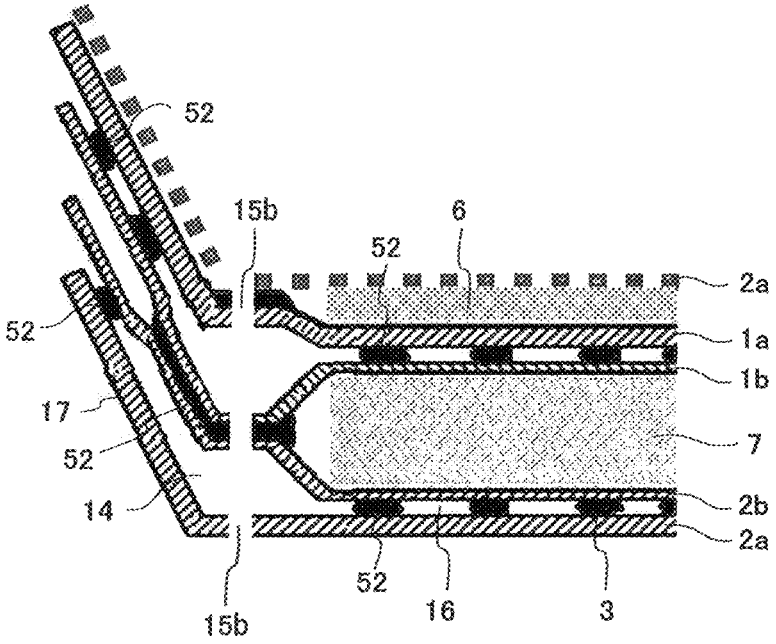
FIG. 29 is a sectional view of the heat transfer set included in the plate heat exchanger according to Embodiment 9 of the present disclosure, which is taken along line B-B in FIG. 27.

FIG. 27 is a front perspective view of a heat transfer set 200 included in a plate heat exchanger 100 according to Embodiment 9 of the present disclosure. FIG. 28 is a sectional view of the heat transfer set 200 included in the plate heat exchanger 100 according to Embodiment 8 of the present disclosure, which is taken along line A-A in FIG. 27. FIG. 29 is a sectional view of the heat transfer set 200 included in the plate heat exchanger 100 according to Embodiment 8 of the present disclosure, which is taken along line B-B in FIG. 27.

As illustrated in FIGS. 27 to 29, in the plate heat exchanger 100 according to Embodiment 9, the peripheral leakage passages 14 that communicate with the fine flow passages 16 are formed between the pairs of metal plates (1*a* and 1*b*) (2*a* and 2*b*) along the inner sides of the outer wall portions 17. The peripheral leakage passages 14 are located outward of the fine flow passages 16 and inward of the outer wall portions 17, and are formed to have projections or recesses on or in portions of the metal plates 1*b* and 2*b* that are located inward of the outer wall portions 17. As illustrated in FIG. 29, outer flow passages 15*b* that are connected with the outside are formed by forming through holes that extend through the outer wall portions 17 of the metal plates 1*a*, 1*b*, 2*a*, and 2*b* in the stacking direction at short sides of the metal plates 1*a*, 1 *b*, 2*a*, and 2*b*.

In the case where the plate heat exchanger 100 is oriented in the vertical direction, the outer flow passages 15*b* that communicate with the peripheral leakage passages 14 are located at upper and lower ends of the plate heat exchanger 100. When the second fluid freezes, for example, and leakage of the second fluid occurs, the outer flow passages 15*b* at the upper end of the plate heat exchanger 100 serve as air inlets, and the second fluid that has leaked is made to promptly flow out through the outer flow passages 15*b* at the lower end of the plate heat exchanger 100. Therefore, by providing a detection sensor closer to the lower end of the plate heat exchanger 100, it is possible to promptly detect the leakage of the second fluid with the detection sensor.

Embodiment 10

Embodiment 10 of the present disclosure will be described. Regarding Embodiment 10, descriptions of components that are same as those in any of Embodiments 1 to 9 will not be made, and components that are the same as or equivalent to those in any of Embodiments 1 to 9 will be denoted by the same reference signs.

Figure 30:
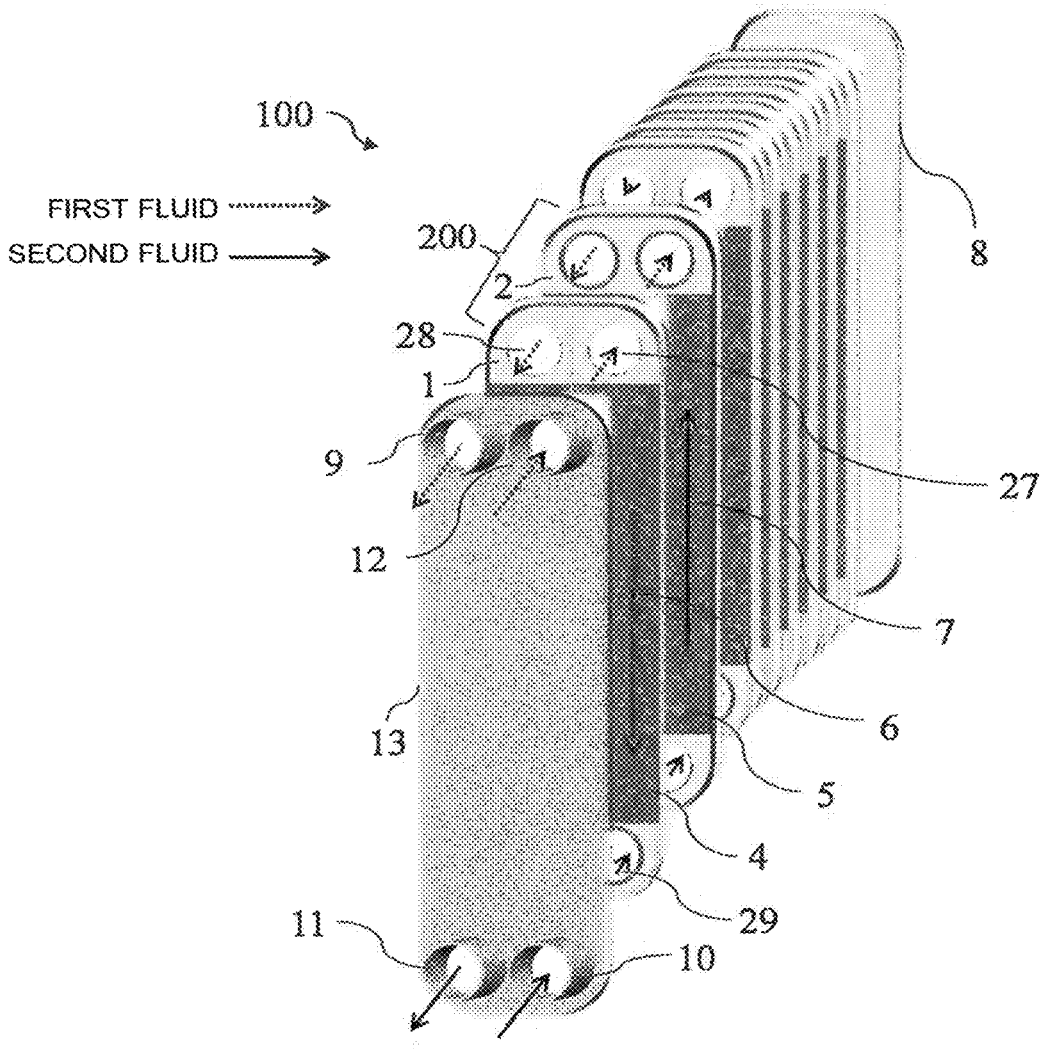
FIG. 30 is an exploded side perspective view of a plate heat exchanger according to Embodiment 10 of the present disclosure.
Figure 31:
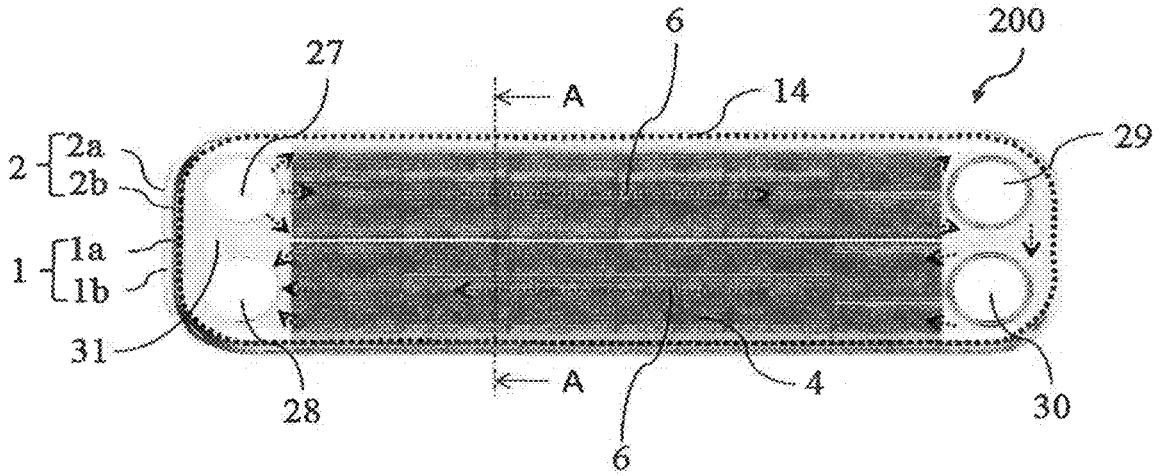
FIG. 31 is a front perspective view of a heat transfer set included in the plate heat exchanger according to Embodiment 10 of the present disclosure.
Figure 32:
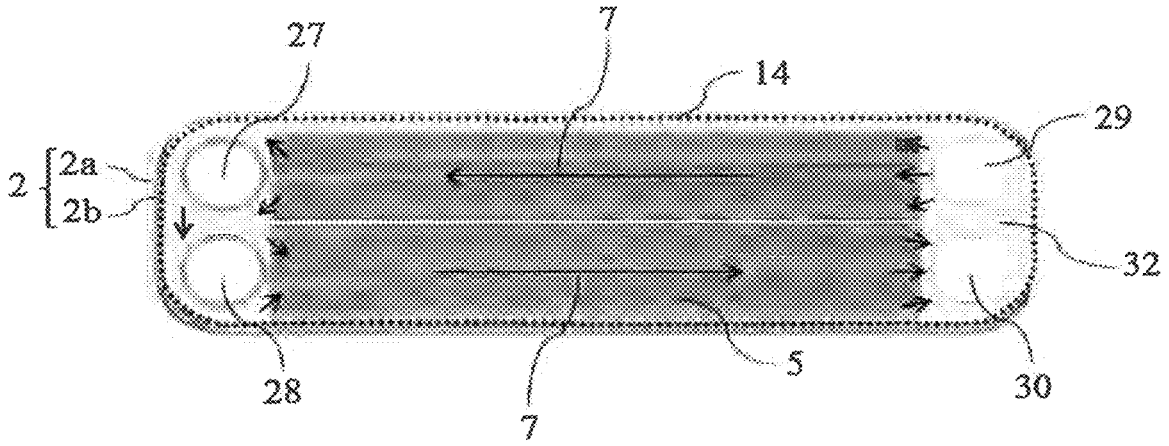
FIG. 32 is a front perspective view of a heat transfer plate included in the plate heat exchanger according to Embodiment 10 of the present disclosure.
Figure 33:
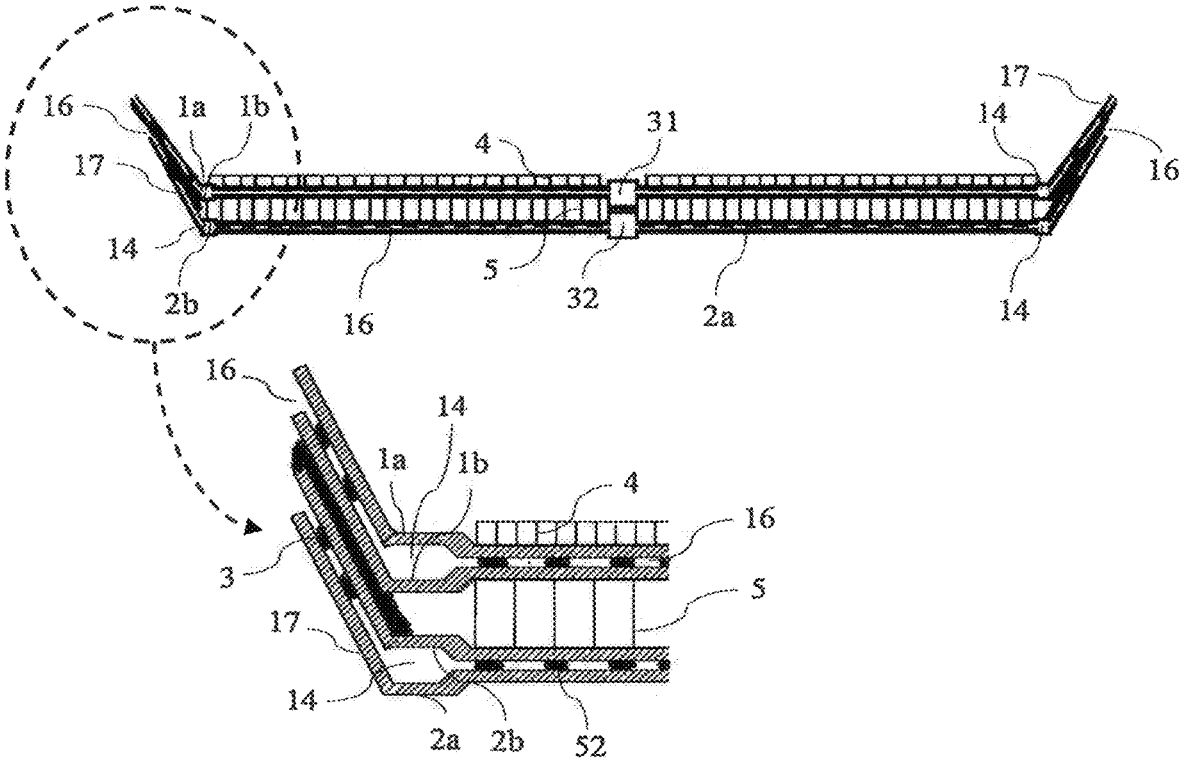
FIG. 33 is a sectional view of the heat transfer set included in the plate heat exchanger according to Embodiment 10 of the present disclosure, which is taken along line A-A in FIG. 31.

FIG. 30 is an exploded side perspective view of a plate heat exchanger 100 according to Embodiment 10 of the present disclosure. FIG. 31 is a front perspective view of a heat transfer set 200 included in the plate heat exchanger 100 according to Embodiment 10 of the present disclosure. FIG. 32 is a front perspective view of a heat transfer plate 2 included in the plate heat exchanger 100 according to Embodiment 10 of the present disclosure. FIG. 33 is a sectional view of the heat transfer set included in the plate heat exchanger according to Embodiment 10 of the present disclosure, which is taken along line A-A in FIG. 31.

As illustrated in FIGS. 30 to 33, in the plate heat exchanger 100 according to Embodiment 10, between the pairs of metal plates (1*a* and 1*b*) (2*a* and 2*b*), respective partition passages 31 and 32 are provided in such a manner as to extend in the longitudinal direction. The partition passages 31 and 32 communicate with the respective peripheral leakage passages 14, and are connected with the outside through the outer flow passages 15.

Referring to FIG. 33, the partition passage 31 is formed by forming a projection on the metal plate 1*a* and a recess in the metal plate 1*b* and joining the metal plates 1*a* and 1 *b* together. The partition passage 32 is formed by forming a projection on the metal plate 2*b* and a recess in the metal plate 2*a* and joining the metal plates 2*a* and 2*b* together.

Although the partition passages 31 and 32 are formed in such a manner as to have projections or recesses on or in the metal plates 1*a*, 1 *b*, 2*a*, and 2*b* as illustrated in FIG. 33, the partition passages 31 and 32 are not limited to such passages. For example, the partition passages 31 and 32 may be formed in such a manner as to projections or recesses on in at least one of the pair of metal plates (1*a* and 1*b*) and at least one of the pair of metal plates (2*a* and 2*b*).

In each first flow passage 6, the projecting outer wall of the associated partition passage 31 (or the projection on the associated metal plate 1*a*) and the recessed outer wall of the associated partition passage 32 (or the recess on the associated metal plate 2*a*) are brazed together to form a partition in the first flow passage 6. Furthermore, in each second flow passage 7, the recessed outer wall of the associated partition passage 31 (or the recess in the associated metal plate 1*b*) and the projecting outer wall of the associated partition passage 32 (or the projection on the associated metal plate 2*b*) are brazed together to form a partition in the second flow passage 7.

As illustrated in FIG. 31, because of provision of the partition in the first flow passage 6, a U-shaped flow can be made in the first flow passage 6. The U-shaped flow in the first flow passage 6 is made such that the first fluid flows into the first flow passage 6 through the opening 27 and flows toward the opening 29 through a flow passage formed between the partition in the first flow passage 6 and the outer wall portions 17 of the first flow passage 6. Then, the first fluid makes a U-turn through a flow passage around the opening 29 and the opening 30, flows toward the opening 28 through another flow passage formed between of the partition in the first flow passage 6 and the outer wall portion 17 of the first flow passage 6, and is made to flow out through the opening 28.

As illustrated in FIG. 32, because of provision of the partition in the second flow passage 7, a U-shaped flow can be made in the second flow passages. The U-shaped flow in the second flow passage 7 is made such that the second fluid flows into the second flow passage 7 through the opening 29 and flows toward the opening 27 through a flow passage formed between the partition in the second flow passage 7 and the outer wall portion 17 of the second flow passage 7. Then, the second fluid makes a U-turn through a flow passage around the opening 27 and the opening 28, flows toward the opening 30 through another flow passage formed between the second flow passage 7 and the outer wall portion 17 of the second flow passage 7, and is made to flow out through the opening 30.

As described above, the partition passages 31 and 32 are connected with the peripheral leakage passages 14. Thus, when leakage of fluid occurs, the flow distance by which the fluid flows after flowing through the fine flow passages 16, that is, the flow distance between the peripheral leakage passages 14 having a height greater than that of the fine flow passages 16 and the partition passages 31 and 32, can be reduced, and the fluid can be made to promptly flow out to the outside. Therefore, the fluid can be made to flow at a flow rate at which the leakage can be detected, and time required to detect the leakage can be reduced. In addition, since the U-shaped flow along the in-plane flow passages can be made because of provision of the partition passages 31 and 32, the in-plane flow passage width can be greatly reduced, and in-plane distribution among the in-plane flow passages can be improved. Therefore, the heat exchange performance of the plate heat exchanger 100 can be improved.

Embodiment 11

Embodiment 11 of the present disclosure will be described. Regarding Embodiment 11, descriptions of components that are same as those in any of Embodiments 1 to 10 will not be made, and components that are the same as or equivalent to those in any of Embodiments 1 to 10 will be denoted by the same reference signs.

Figure 34:
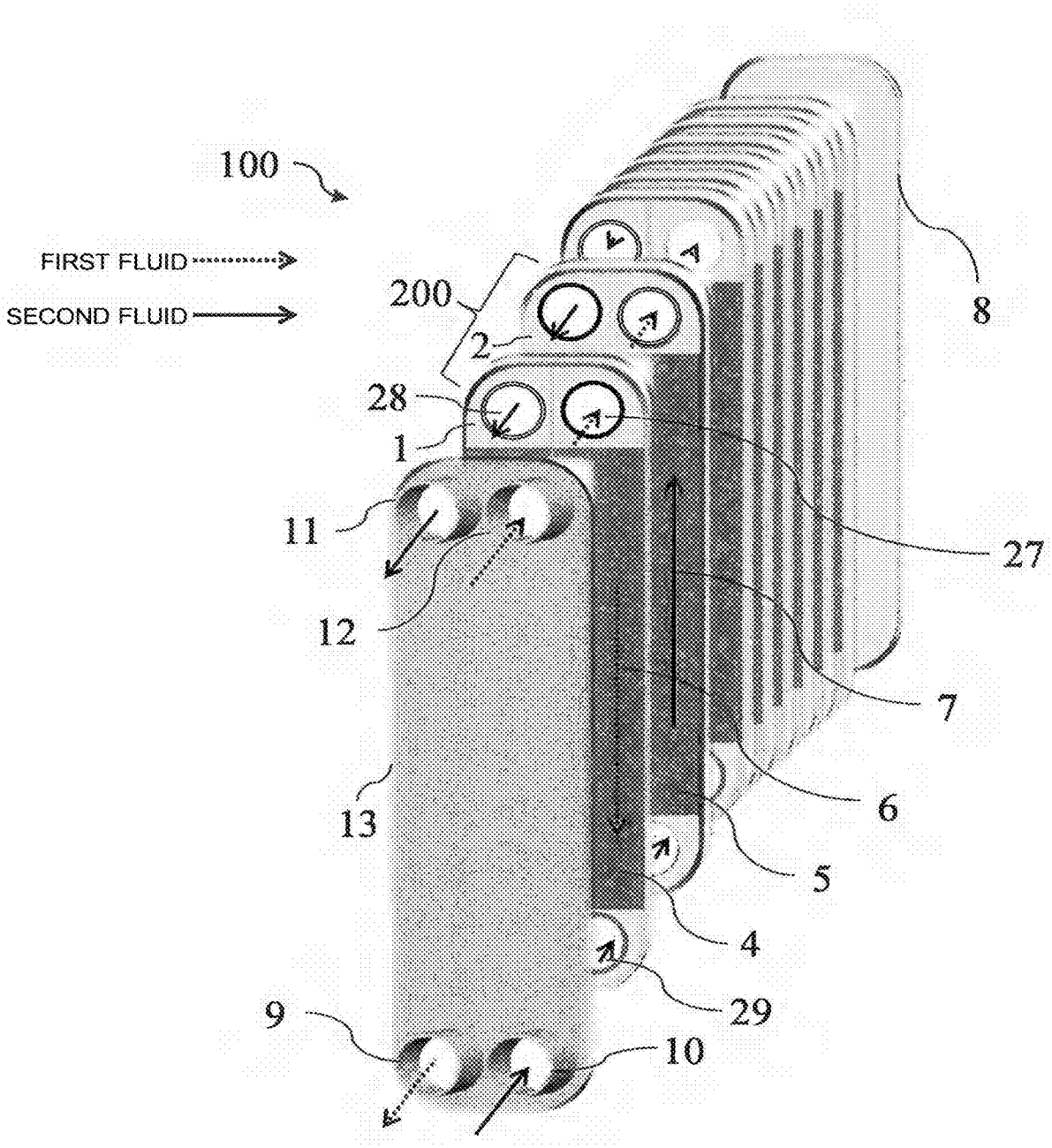
FIG. 34 is an exploded side perspective view of a plate heat exchanger according to Embodiment 11 of the present disclosure.
Figure 35:
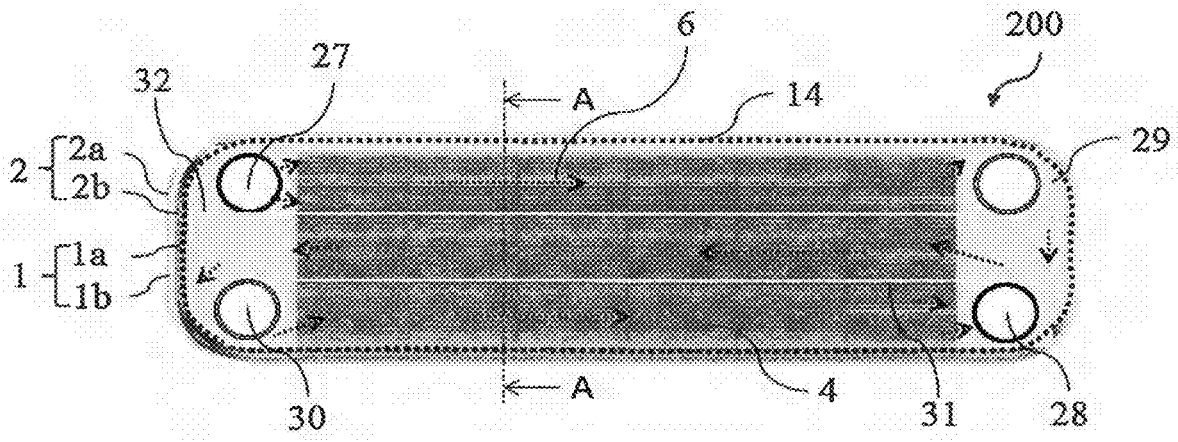
FIG. 35 is a front perspective view of a heat transfer set included in the plate heat exchanger according to Embodiment 11 of the present disclosure.
Figure 36:
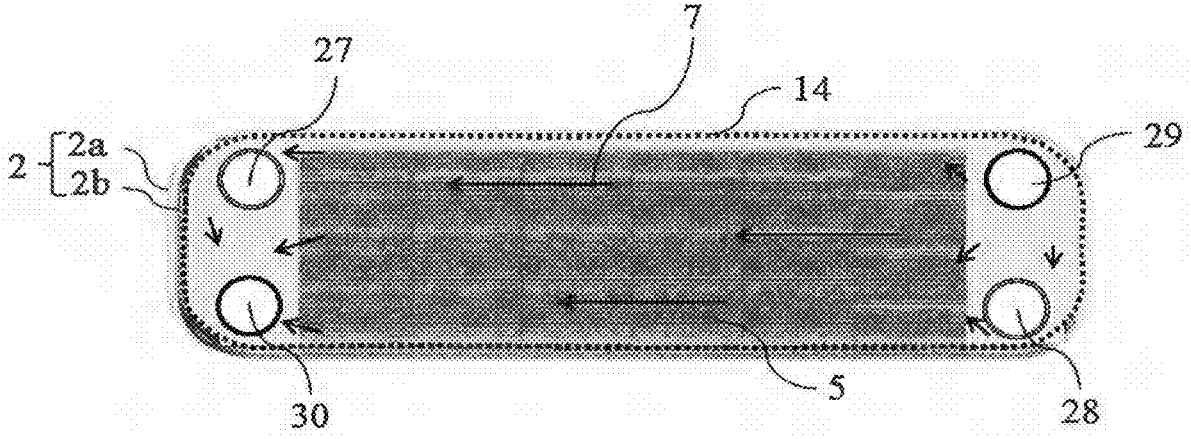
FIG. 36 is a front perspective view of a heat transfer plate included in the plate heat exchanger according to Embodiment 11 of the present disclosure.
Figure 37:
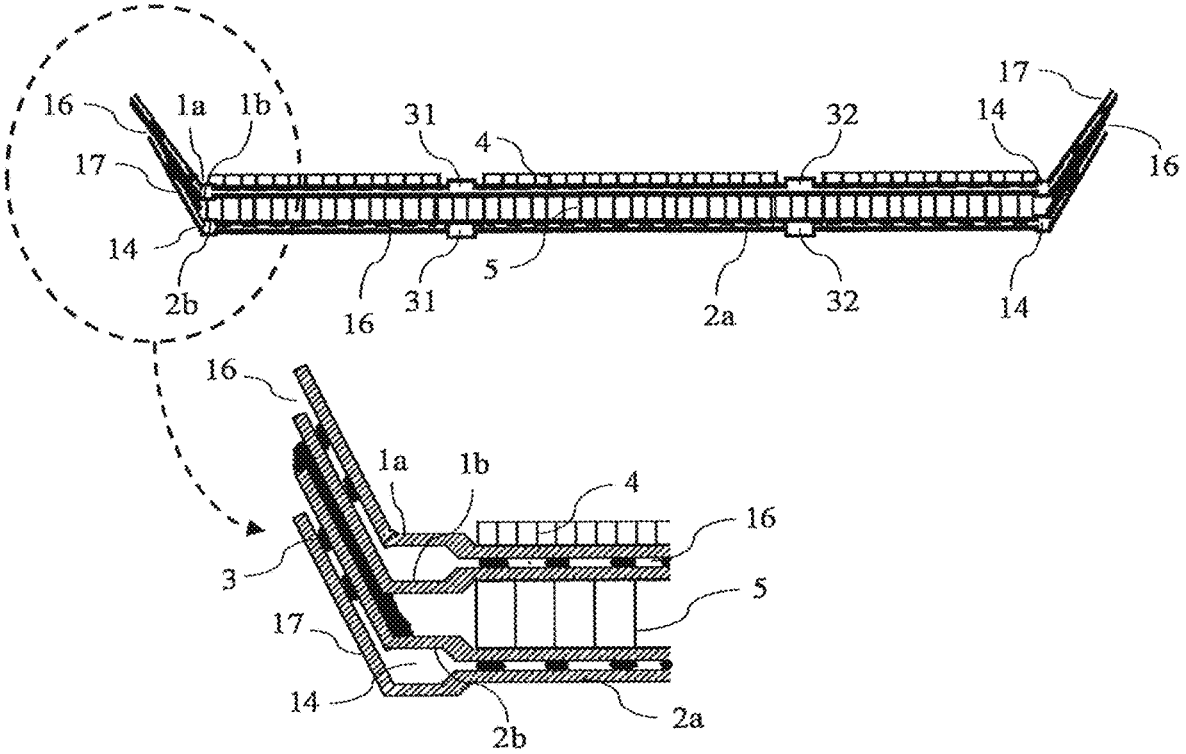
FIG. 37 is a sectional view of the heat transfer set included in the plate heat exchanger according to Embodiment 11 of the present disclosure, which is taken along line A-A in FIG. 35.

FIG. 34 is an exploded side perspective view of a plate heat exchanger 100 according to Embodiment 11 of the present disclosure. FIG. 35 is a front perspective view of a heat transfer set 200 included in the plate heat exchanger 100 according to Embodiment 11 of the present disclosure. FIG. 36 is a front perspective view of a heat transfer plate 2 included in the plate heat exchanger 100 according to Embodiment 11 of the present disclosure. FIG. 37 is a sectional view of the heat transfer set included in the plate heat exchanger 100 according to Embodiment 11 of the present disclosure, which is taken along line A-A in FIG. 35.

As illustrated in FIGS. 34 to 37, in the plate heat exchanger 100 according to Embodiment 11, between the pairs of metal plates (1*a* and 1*b*) (2*a* and 2*b*), respective partition passages 31 and 32 are provided in such a manner as to extend in the longitudinal direction. The partition passages 31 and 32 communicate with the peripheral leakage passages 14, and are connected with the outside through the outer flow passages 15.

As illustrated in FIG. 37, the partition passage 31 is formed by forming a projection on the metal plate 1*a* and joining the metal plate 1*a* and the metal plate 1*b* together. The partition passage 32 is formed by forming a recess in the metal plate 2*a* and joining the metal plate 2*a* and the metal plate 2*b* together.

In each first flow passage 6, the projecting outer wall of the associated partition passage 31 (or the projection on the associated metal plate 1*a*) and the recessed outer wall of the associated partition passage 31 (or the recess in the associated metal plate 2*a*) are brazed together to form a first partition in the first flow passage 6. In addition, in each first flow passage 6, the projecting outer wall of the associated partition passage 32 (or the projection on the associated metal plate 1*a*) and the recessed outer wall of the associated partition passage 32 (or the recess on the associated metal plate 2*a*) are brazed together to form a second partition in the first flow passage 6. It should be noted that in each second flow passage 7 no partition is provided.

As illustrated in FIG. 35, because of provision of the partitions in the first flow passage 6, two U-shaped flows can be made. The two U-shaped flows in the first flow passages 6 are made such that the first fluid flows into the first flow passage 6 through the opening 27 and flows toward the opening 29 through a flow passage formed between the first one of the partitions in the first flow passage 6 and the outer wall portion 17 of the first flow passage 6. Then, the first fluid makes a first U-turn through a flow passage around the opening 29 and along the second partition, and flows toward the opening 30 through a flow passage formed between the above first partition and the second one of the partitions. Then, the first fluid makes a second U-turn through a flow passage around the opening 30 and along the first partition, flows through a flow passage formed between the above second partition in the first flow passage 6 and the outer wall portion 17 of the first flow passage 6, and is made to flow out through the opening 28.

As illustrated in FIG. 36, each second flow passage 7 has no partition. Thus, the second fluid enters the second flow passage 7 through the opening 29, flows diagonally toward the opening 30 through a flow passage formed between the outer wall portions 17 of the second flow passage 7, and is made to flow out through the opening 30.

As described above, the partition passages 31 and 32 are connected with the peripheral leakage passages 14. Therefore, when leakage of fluid occurs, the flow distance by which the fluid flows after flowing through the fine flow passages 16, that is, the flow distance between the peripheral leakage passages 14 having a height greater than that of the fine flow passages 16 and the partition passages 31 and 32, can be further reduced, and the fluid can be made to promptly flow out to the outside.

Therefore, the fluid can be made to flow at a flow rate at which the leakage can be detected, and time required to detect the leakage can be reduced. In addition, since the two U-shaped flows along the in-plane flow passages can be made because of provision of the partition passages 31 and 32, the in-plane flow passage width can be further greatly reduced, and in-plane distribution among the in-plane flow passages can thus be improved. Therefore, the heat exchange performance of the plate heat exchanger 100 can be improved.

Embodiment 12

Embodiment 12 of the present disclosure will be described. Regarding Embodiment 12, descriptions of components that are same as those in any of Embodiments 1 to 11 will not be made, and components that are the same as or equivalent to those in any of Embodiments 1 to 11 will be denoted by the same reference signs.

Figure 38:
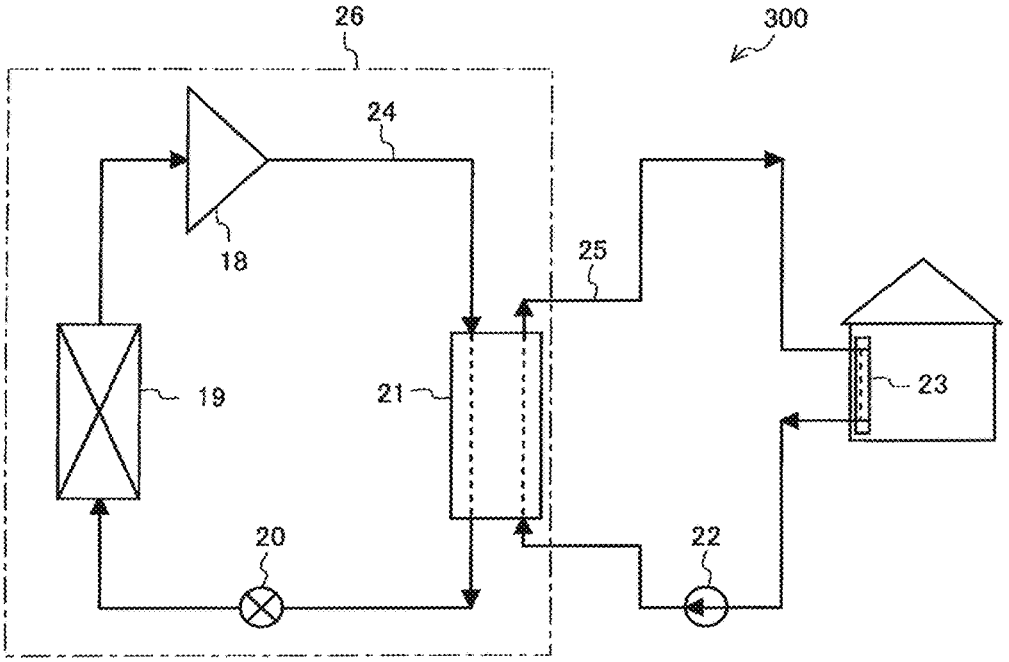
FIG. 38 is a schematic diagram illustrating the structure of a heat pump cooling, heating, and hot water supply system according to Embodiment 12 of the present disclosure.

FIG. 38 is a schematic diagram illustrating the configuration of a heat pump cooling, heating, and hot water supply system 300 according to Embodiment 12 of the present disclosure.

A heat pump type of cooling, heating, and hot water supply system 300 according to Embodiment 12 includes a heat pump device 26 provided in a housing. The heat pump device 26 includes a refrigerant circuit 24 and a heat medium circuit 25. In the refrigerant circuit 24, a compressor 18, a second heat exchanger 19, a pressure reducing device 20, and a first heat exchanger 21 are sequentially connected by pipes. The pressure reducing device 20 is, for example, an expansion valve or a capillary tube. In the heat medium circuit 25, the first heat exchanger 21, a cooling, heating, and hot water supply apparatus 23, and a pump 22 are sequentially connected by pipes. The pump 22 circulates a heat medium.

The first heat exchanger 21 is the plate heat exchanger 100 described above regarding Embodiments 1 to 11, and causes heat exchange to be performed between refrigerant that is circulated in the refrigerant circuit 24 and the heat medium that is circulated in the heat medium circuit 25. The heat medium that is circulated in the heat medium circuit 25 may be a fluid that can exchange heat with the refrigerant in the refrigerant circuit 24, such as water, ethylene glycol, propylene glycol, or a mixture thereof.

The plate heat exchanger 100 is provided in the refrigerant circuit 24 such that the refrigerant flows through the first flow passages 6, whose heat transfer performance is higher than that of the second flow passages 7, and the heat medium flows through the second flow passages 7.

In the plate heat exchanger 100, the heat transfer plates 1 and 2, which are located between the first flow passages 6 and the second flow passages 7, have the outer flow passages 15 connected with the outside. Thus, in the plate heat exchanger 100 provided in the refrigerant circuit 24, even when corrosion of the first flow passages 6 or freezing of the second flow passages 7 occurs, the refrigerant that flows through the first flow passages 6 does not leak into the second flow passages 7.

The cooling, heating, and hot water supply apparatus 23 includes a hot water tank (not illustrated) and an indoor unit (not illustrated) that air-conditions an indoor space. In the case where the heat medium is water, water is caused to exchange heat with the refrigerant in the refrigerant circuit 24 and is thereby heated in the plate heat exchanger 100, and the heated water is stored in the hot water tank (not illustrated). The indoor unit (not illustrated) cools or heats the indoor space by guiding the heat medium in the heat medium circuit 25 into a heat exchanger included in the indoor unit and causing the heat medium to exchange heat with air in the indoor space. It should be noted that the configuration of the cooling, heating, and hot water supply apparatus 23 is not limited to the above configuration. That is, as the configuration of the cooling, heating, and hot water supply apparatus 23, any configuration may be applied as long as the configuration is made to enable the cooling, heating, and hot water supply operations to be performed using heating energy of the heat medium in the heat medium circuit 25.

As described above regarding Embodiments 1 to 11, the plate heat exchanger 100 has a high heat exchange efficiency, and allows flammable refrigerant (for example, R32, R290, or $HFO_{MIX}$) to be used in the plate heat exchanger 100. In addition, the plate heat exchanger 100 is made to have a higher strength and thus has high reliability. Therefore, in the case where the plate heat exchanger 100 is provided in the heat pump type of cooling, heating, a heat pump type of heating, cooling, and hot water supply system 300 can be obtained in which a high efficiency is achieved, the power consumption is reduced, the safety is improved, and $CO_2$ emissions can be reduced.

In Embodiment 12, the heat pump type of cooling, heating, and hot water supply system 300 that causes heat exchange to be performed between refrigerant and water is described as an example of a system to which the plate heat exchanger 100 according to any of Embodiments 1 to 11 may be applied. However, the system or apparatus, or device to which the plate heat exchangers 100 according to any of Embodiments 1 to 11 are applied is not limited to the heat pump type of cooling, heating, and hot water supply system 300. That is, the plate heat exchanger 100 according to any of Embodiments 1 to 11 may be applied to various industrial and domestic apparatuses or devices, such as a cooling chiller, a power generating apparatus, or a heat sterilization device for food.

As an example of application of the present disclosure, the plate heat exchangers 100 described regarding Embodiments 1 to 11 may be applied to a heat pump device that is easy to manufacture and required to have an improved heat exchange performance and an improved energy saving performance.

Reference Signs List heat transfer plate 1*a* metal plate 1*b* metal plate 2 heat transfer plate 2*a* metal plate 2*b* metal plate 4 inner fin 5 inner fin 6 first flow passage 7 second flow passage 8 second reinforcing side plate 9 first outlet pipe 10 second inlet pipe 11 second outlet pipe 12 first inlet pipe 13 first reinforcing side plate 14 peripheral leakage passage 15 outer flow passage 15*a* outer flow passage 15*b* outer flow passage 16 fine flow passage 17 outer wall portion 18 compressor 19 second heat exchanger 20 pressure reducing device 21 first heat exchanger 22 pump 23 cooling, heating, and hot water supply apparatus 24 refrigerant circuit 25 heat medium circuit 26 heat pump device 27 opening 28 opening 29 opening 30 opening 31 partition passage 32 partition passage 40 first header 41 second header 52 brazed portion 100 plate heat exchanger 200 heat transfer set 300 heat pump cooling, heating, and hot water supply system

The invention claimed is:

1. A plate heat exchanger comprising:

a plurality of heat transfer plates each of which has openings at four corners thereof, the plurality of heat transfer plates having outer wall portions at edges thereof and being stacked together, wherein the plurality of heat transfer plates are partially brazed together such that a first flow passage through which first fluid flows and a second flow passage through which second fluid flows are alternately provided, with an associated one of the plurality of heat transfer plates interposed between the first flow passage and the second flow passage, the openings at the corners of the plurality of heat transfer plates being provided such that the openings at each of the corners communicate with each other, thereby forming a first header and a second header, the first header being configured to allow the first fluid to flow into and flow out of the first flow passage, the second header being configured to allow the second fluid to flow into and flow out of the second flow passage, wherein at least one of two of the plurality of heat transfer plates between which the first flow passage or the second flow passage is located is formed by stacking two metal plates together, and wherein space between the two metal plates includes a fine flow passage that is located within a heat exchange region in which the first fluid and the second fluid exchange heat, and a peripheral leakage passage provided outward of the fine flow passage to communicate with the outside of the space and having a hydraulic diameter greater than a hydraulic diameter of the fine flow passage.

2. The plate heat exchanger of claim 1, wherein one of the two of the plurality of heat transfer plates between which the first flow passage or the second flow passage is provided is a single metal plate.

3. The plate heat exchanger of claim 1, wherein at least one of the two metal plates is processed to have a projection or a recess that forms the peripheral leakage passage.

4. The plate heat exchanger of claim 1, wherein the metal plates between which the second flow passage is located are thinner than the metal plates between which the first flow passage is located.

5. The plate heat exchanger of claim 4, wherein the metal plates that are thinner are processed to have projections that form the peripheral leakage passage.

6. The plate heat exchanger of claim 1, wherein the two metal plates are partially brazed together at brazed portions such that a plurality of the fine flow passages are formed in the heat exchange region between the metal plates.

7. The plate heat exchanger of claim 1, wherein a plurality of outer flow passages are provided outward of the peripheral leakage passage, and at least one or more of the plurality of outer flow passages are connected with the outside.

8. The plate heat exchanger of claim 7, wherein only some of the plurality of outer flow passages are connected with the outside.

9. The plate heat exchanger of claim 7, wherein only one of the plurality of outer flow passages is connected with the outside.

10. The plate heat exchanger of claim 1, wherein the outer wall portions are not brazed together.

11. The plate heat exchanger of claim 7, wherein the plurality of outer flow passages are formed by forming through holes that extend through the outer wall portions in a stacking direction.

12. The plate heat exchanger of claim 1, wherein the peripheral leakage passage is provided inward of the outer wall portions and outward of the fine flow passage.

13. The plate heat exchanger of claim 1, wherein the peripheral leakage passage is provided between the outer wall portions.

14. The plate heat exchanger of claim 1, wherein at least one of the pair of metal plates is processed to have a projection or a recess that forms a partition passage.

15. The plate heat exchanger of claim 14, wherein the partition passage is connected with the peripheral leakage passage.

16. The plate heat exchanger of claim 14, wherein an outer wall of the partition passage is brazed to form a partition in the first flow passage or the second flow passage.

17. The plate heat exchanger of claim 14, wherein an in-plane flow in the first flow passage or the second flow passage is a U-shaped flow.

18. A heat pump device comprising:

a refrigerant circuit in which a compressor, a heat exchanger, a pressure reducing device, and the plate heat exchanger of claim 1 are connected, and refrigerant is circulated; and a heat medium circuit in which a heat medium is circulated, the heat medium exchanging heat with the refrigerant in the plate heat exchanger.

19. A heat pump type of cooling, heating, and hot water supply system comprising: the heat pump device of claim 18; a cooling, heating, and hot water supply apparatus that performs a cooling operation, a heating operation, and a hot water supply operation, using heating energy of the heat medium; and a pump provided in the heat medium circuit, and configured to circulate the heat medium.

* * * * *